US008933316B2

(12) United States Patent
Fujiwara et al.

(10) Patent No.: US 8,933,316 B2
(45) Date of Patent: Jan. 13, 2015

(54) METHOD AND APPARATUS FOR IDENTIFYING HALF PEDAL REGION IN KEYBOARD MUSICAL INSTRUMENT

(71) Applicant: Yamaha Corporation, Hamamatsu-shi, Shizuoka-Ken (JP)

(72) Inventors: Yuji Fujiwara, Hamamatsu (JP); Yasuhiko Oba, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 14/250,930

(22) Filed: Apr. 11, 2014

(65) Prior Publication Data

US 2014/0305276 A1 Oct. 16, 2014

(30) Foreign Application Priority Data

Apr. 11, 2013 (JP) ..... 2013-082849

(51) Int. Cl.
*G10H 3/00* (2006.01)
*G10H 1/32* (2006.01)
*G10C 3/26* (2006.01)

(52) U.S. Cl.
CPC ..... *G10C 3/26* (2013.01)
USPC ..... 84/746; 84/21

(58) Field of Classification Search
CPC ..... G10F 1/02; G10F 5/00; G10C 3/26; G10H 2230/011
USPC ..... 84/746, 13, 19, 21
See application file for complete search history.

(56) References Cited

U.S. PATENT DOCUMENTS

| | | | | |
|---|---|---|---|---|
| 5,523,522 | A * | 6/1996 | Koseki et al. | 84/21 |
| 5,714,702 | A * | 2/1998 | Ishii | 84/462 |
| 5,905,220 | A * | 5/1999 | Lee et al. | 84/461 |
| 5,936,172 | A * | 8/1999 | de La Rochefordiere | 84/217 |
| 7,332,670 | B2 * | 2/2008 | Fujiwara et al. | 84/744 |
| 7,381,880 | B2 | 6/2008 | Fujiwara et al. | |
| 7,521,626 | B2 | 4/2009 | Muramatsu | |
| 7,943,843 | B2 * | 5/2011 | Komatsu | 84/615 |
| 2006/0021488 | A1 * | 2/2006 | Fujiwara et al. | 84/13 |
| 2013/0180377 | A1 * | 7/2013 | Oba et al. | 84/229 |

FOREIGN PATENT DOCUMENTS

| | | | |
|---|---|---|---|
| JP | 2007292921 | A | 11/2007 |
| JP | 4305319 | B2 | 5/2009 |
| JP | 4524798 | B2 | 6/2010 |

* cited by examiner

*Primary Examiner* — Jeffrey Donels
(74) *Attorney, Agent, or Firm* — Rossi, Kimms & McDowell LLP

(57) ABSTRACT

Each of Dampers provided for each of keys is controlled in response to both an operation of a damper pedal and an operation of the corresponding key. For each of the dampers and over one stroke of the pedal in at least one of depressing releasing directions of the pedal, load information indicative of loads imposed on a portion linked to the damper is acquired in association with individual stroke positions of the pedal. Then, for each of the dampers, a half pedal region is identified on the basis of relationship between the stroke positions and the loads corresponding to the stroke positions. The portion linked to the damper may be any suitable portion related to a damper lever moving in an up-down direction in interlocked relation to both of vertical movement of a lifting rail responsive to an operation of the pedal and an operation of the key.

15 Claims, 12 Drawing Sheets

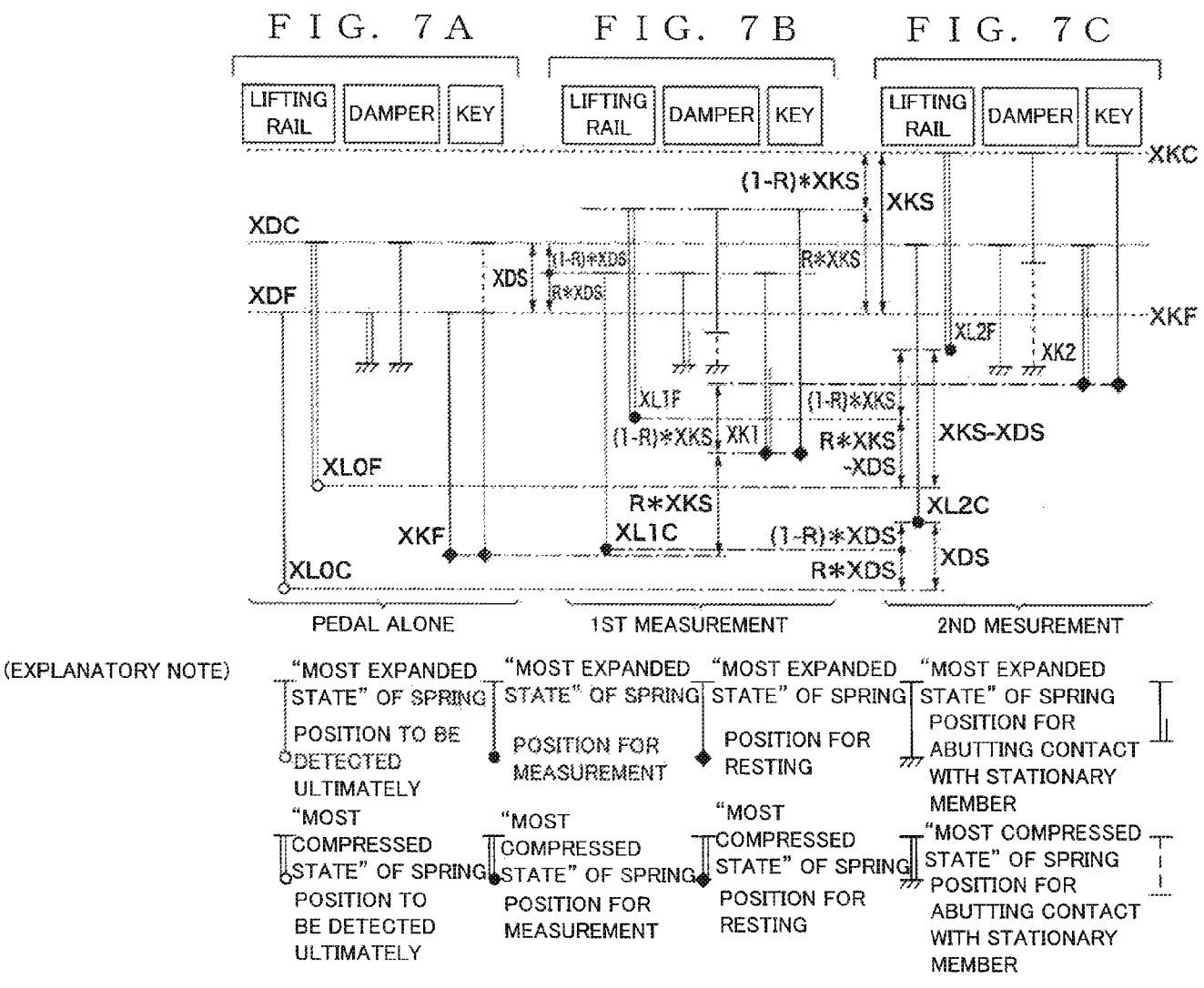
FIG. 7A
FIG. 7B
FIG. 7C
LIFTING RAIL
DAMPER
KEY
XDC
XDF
XDS
(1-R)*XDS
R*XDS
XLOF
XLOC
XKF
XKC
XKS
(1-R)*XKS
R*XKS
XL1F
XL1C
XK1
XL2F
XL2C
XK2
XKS-XDS
R*XKS-XDS
(1-R)*XDS
PEDAL ALONE
1ST MEASUREMENT
2ND MESUREMENT
(EXPLANATORY NOTE)
"MOST EXPANDED STATE" OF SPRING
POSITION TO BE DETECTED ULTIMATELY
POSITION FOR MEASUREMENT
POSITION FOR RESTING
POSITION FOR ABUTTING CONTACT WITH STATIONARY MEMBER
"MOST COMPRESSED STATE" OF SPRING
POSITION TO BE DETECTED ULTIMATELY
POSITION FOR MEASUREMENT
POSITION FOR RESTING
POSITION FOR ABUTTING CONTACT WITH STATIONARY MEMBER

METHOD AND APPARATUS FOR IDENTIFYING HALF PEDAL REGION IN KEYBOARD MUSICAL INSTRUMENT

BACKGROUND

The present invention relates generally to a method and apparatus for identifying half pedal region existing in relationship between a damper pedal and a damper in a keyboard musical instrument including string sets and dampers, as well as a non-transitory computer-readable storage medium storing program instructions for causing a computer to perform such a method.

Typically, keyboard musical instruments, which are constructed to generate a tone in response to striking of a string set (comprising one or more strings), have, for each of keys, a damper that is brought into and out of contact with the corresponding string set. As well known, the keyboard musical instruments are provided with a loud pedal (damper pedal) for controlling behavior of the dampers. Generally, in a depression stroke of the loud pedal (damper pedal), there are three different regions: a "play region (or rest region)" where no influence of depression of the loud pedal is transmitted to the dampers; a half pedal region from a point where reduction of pressing contact force applied from the dampers to the string sets is started to a point where the dampers are brought out of contact with the string sets; and a "string-releasing region" where, following the above-mentioned half pedal region, the dampers are completely spaced from the string sets.

Also known are keyboard musical instruments which can be caused to execute an automatic performance, including pedal operation, by supplying a driving electric current to a solenoid coil to drive a pedal in accordance with performance data. In an automatic performance on such a keyboard musical instrument, it is desirable, particularly in order to enhance reproducibility of the performance, that appropriate control be performed on the loud pedal and the like to provide appropriate pedal operation matching the above-mentioned half pedal region. For example, in performing feedback control etc. of pedal operation based on performance data, it would be important to properly identify the half pedal region and have the identified half pedal region reflected in the control.

Thus, there have heretofore been proposed methods or techniques for accurately and easily identifying a half pedal region and a half point present in that half pedal region. Japanese Patent No. 4524798, for example, discloses a technique for observing driving loads on a pedal to identify a half point of the pedal. Further, Japanese Patent Application Laid-open Publication No. 2007-292921 discloses detecting vibrations of a soundboard to identify a half point of the pedal.

As known, a lifting rail is connected to the loud pedal, and the lifting rail moves vertically upward and downward in response to an operation of the pedal. As the loud pedal is depressed, damper levers are driven to pivot via the lifting rail, so that all of the dampers ascend via damper wires. Thus, damper felts of all of the dampers are brought from a string-contacting state or position (damper-on position) to a non-string-contacting state or position (damper-off position).

As generally known, the "half pedal region" in relationship between the loud pedal and the dampers responsive to an operation of the loud pedal is a concept derived when the dampers of all of the keys are regarded as behaving similarly with respect to a pedal stroke. Namely, till now, the half pedal region of the conventionally-known loud pedal has been treated as a single half pedal region common to the dampers of the individual keys without being distinguished among the dampers of the keys.

However, if it is assumed that such a half pedal region can differ among the dampers of the individual keys to be precise, a start point of the conventional common half pedal region can be considered to exist between a point when the first one of the dampers starts to be driven and a point when the last one of the dampers starts to be driven. Further, an end point of the conventional common half pedal region can be considered to exist between a point when the first one of the dampers gets out of contact with the corresponding string set and a point when the last one of the dampers gets out of contact with the corresponding string set.

As a matter of fact, the lifting rail elongated in a horizontal or left-right direction is supported at its portion connected with the pedal and cantilevered at the supported portion, so that flexural deformation may occur in the lifting rail and hence the lifting rail may not always extend in a complete horizontal direction. Therefore, strictly speaking, the lifting rail may undesirably differ in height position depending on its portions in the horizontal, left-right direction, and thus, the start and end points of the half pedal region may differ among the dampers of the individual keys.

Also, there may be undesirable variation in position and dimensions among the dampers of the individual keys. Further, resiliency of a damper lever felt interposed between the lifting rail and the damper lever as well as resiliency of the damper belt directly contacting the sting set would also influence the half pedal region. These factors would also cause the half pedal region to vary among the dampers of the individual keys.

In the case where the half pedal region differs among the dampers of the individual keys in the strict sense of the term, some of the dampers may actually start ascending at the start point of the half pedal region in response to depression of the pedal while others may not actually start ascending at the start point of the half pedal region in response to depression of the pedal.

Normally, in product shipment, positions and dimensions of component parts responsible for the half pedal region are adjusted so that variation in half pedal region among tone pitches can be minimized. However, perfect setting and adjustment of the component parts is not easy, and thus, it is not easy to allow the half pedal region to be completely the same among the dampers.

The aforementioned patent literatures do not disclose an idea of considering the half pedal region separately for each of the dampers of the keys, and, in fact, it is difficult to accurately identify the half pedal region separately for each of the keys responsive to an operation of the pedal. Although it is desirable to allow a half pedal region to be identified separately for each of the dampers of the keys in order to realize accurate tuning, no effective method for meeting this desire has been established yet.

SUMMARY OF THE INVENTION

In view of the foregoing prior art problems, the present invention seeks to provide a technique for allowing a half pedal region to be accurately identified per key.

Note that, in this specification, the terms "sound" and "tone" are used interchangeably with each other.

In order to accomplish the above-mentioned object, the present invention provides an improved method for identifying a half pedal region in a keyboard musical instrument, the keyboard musical instrument including: a plurality of keys; a plurality of dampers provided in corresponding relation to the keys; and a pedal configured to control damping action of the plurality of dampers, the half pedal region being an operating region where neither effectiveness of the damper nor cancellation of the effectiveness of the damper responsive to an operation of the pedal is sufficient, the method comprising: an acquisition step of acquiring, for each of the dampers and over one stroke of the pedal in at least one of a depressing direction and a releasing direction of the pedal, loads imposed on a portion linked to the damper, in association with individual stroke positions of the pedal; and an identification step of identifying, for each of the dampers, a half pedal region on the basis of relationship between the individual stroke positions and the loads, acquired by the acquisition step, corresponding to the individual stroke positions.

According to the present invention, for each of the dampers and over one stroke of the pedal in at least one of the depressing releasing directions of the pedal, load information indicative of loads imposed on the portion linked to the damper is acquired in association with individual stroke positions of the pedal. Then, for each of the dampers of the keys, a unique half pedal region is identified on the basis of relationship between the individual stroke positions and the loads corresponding to the individual stroke positions. Such damper-specific half pedal regions identified in the aforementioned manner can be used advantageously in various scenes. For example, information of the identified damper-specific half pedal regions may be stored in a memory, so that, when an automatic performance is to be executed on the keyboard musical instrument, an automatic performance using half regions of a damper pedal can be executed appropriately in accordance with the stored information of the damper-specific half pedal regions.

According to the present invention, the load acquisition is performed by measuring loads imposed on the portion linked to the damper. The portion linked to the damper may be any suitable portion related to a damper lever moving in an up-down direction in interlocked relation to both of vertical movement of a lifting rail responsive to an operation of the pedal and an operation of the key, or alternatively it may be a portion of the key acting on the damper. In the former case where loads imposed on any suitable portion related to the damper lever are measured, a pressure sensor, strain sensor or the like may be provided on the suitable portion. In the latter case where loads imposed on a portion of the key acting on the damper are measured, loads imposed on the key drive unit, already provided for automatically driving the key, can be advantageously measured on the basis of servo driving values of the key drive unit.

Thus, in a preferred embodiment, the acquisition step includes for each of the dampers: a step of performing first measurement for measuring, as the loads imposed on the portion linked to the damper and with the key corresponding to the damper maintained at a first half position, loads imposed on a portion of the key acting on the damper, in association with the individual stroke positions of the pedal, the first half position being a position in a key-damper half region except for a rest-position-side end position of the key-damper half region, the key-damper half region being an operating region of the key where neither effectiveness of the damper nor cancellation of the effectiveness of the damper responsive to an operation of the key is sufficient; and a step of performing second measurement for measuring, as the loads imposed on the portion linked to the damper and with the key corresponding to the damper maintained at a second half position, loads imposed on the portion of the key acting on the damper, in association with the individual stroke positions of the pedal, the second half position being a position in the key-damper half region except for the rest-position-side end position and the first half position of the key-damper half region.

In a further preferred embodiment, the keyboard musical instrument further includes key drive units provided in corresponding relation to the plurality of keys and configured to be capable of driving the plurality of keys independently of each other, and wherein the steps of performing the first measurement and the second measurement each measure, as the loads imposed on the portion of the key acting on the damper, loads imposed on the key drive unit corresponding to the key.

In an embodiment, for each of the dampers, the identification step identifies first two sudden change points at which a curve indicative of relationship between the stroke positions and the loads measured by the first measurement suddenly changes in inclination, identifies second two sudden change points at which a curve indicative of relationship between the stroke positions and the loads measured by the second measurement suddenly changes in inclination, and identifies the half pedal region on the basis of the first two sudden change points and the second two sudden change points.

In an embodiment, the acquisition step moves the pedal at a substantially constant speed over the one stroke in the at least one of the depressing direction and the releasing direction of the pedal.

The present invention may be constructed and implemented not only as the method invention discussed above but also as an apparatus invention. Also, the present invention may be arranged and implemented as a software program for execution by a processor, such as a computer or DSP, as well as a non-transitory computer-readable storage medium storing such a software program. In this case, the program may be provided to a user in the storage medium and then installed into a computer of the user, or delivered from a server apparatus to a computer of a client via a communication network and then installed into the client's computer. Further, the processor used in the present invention may comprise a dedicated processor with dedicated logic built in hardware, not to mention a computer or other general-purpose processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 7A to 7C are conceptual diagrams showing a method for identifying a half pedal region in modeled representations;

DETAILED DESCRIPTION

Figure 1:
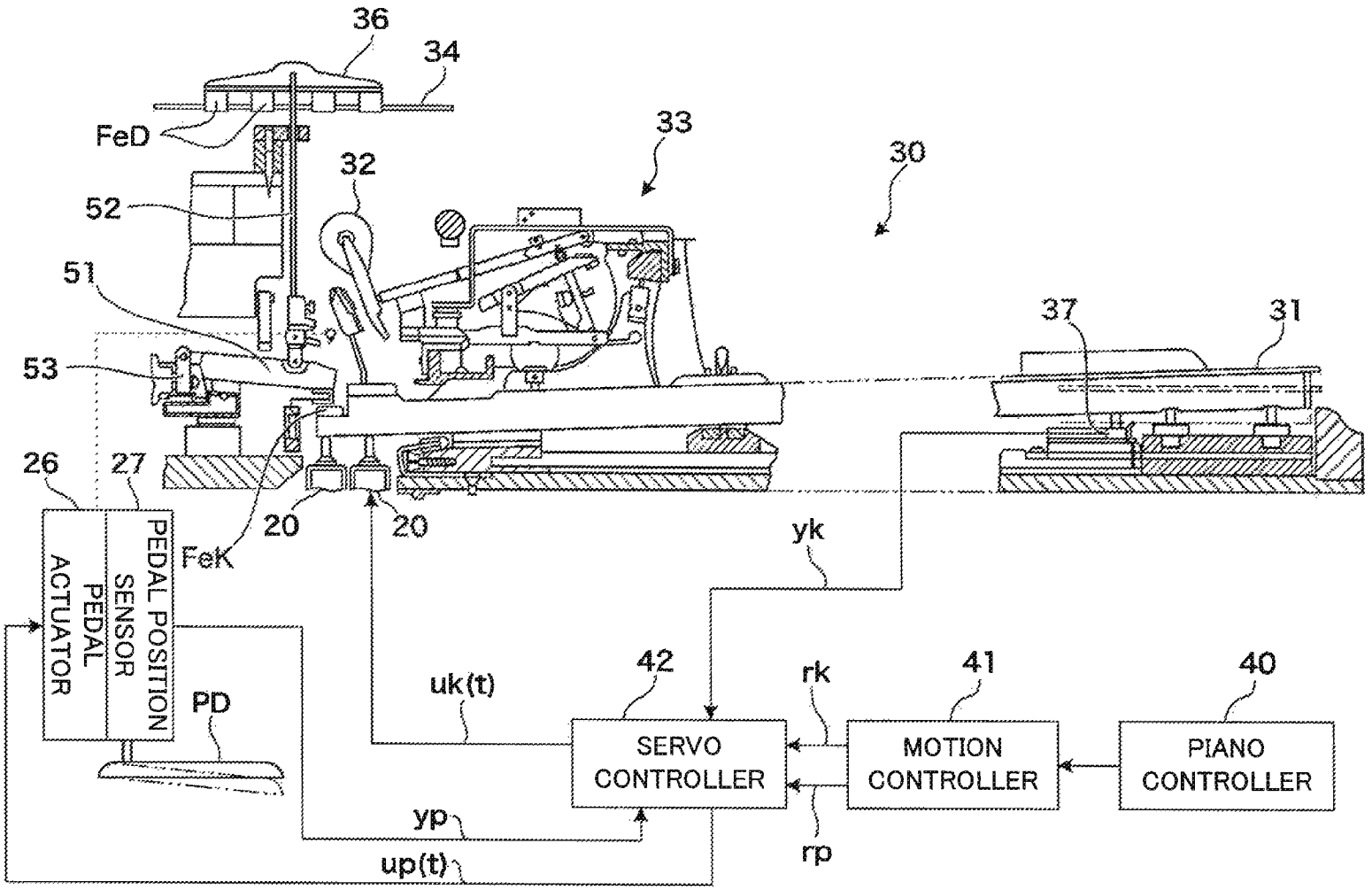
FIG. 1 is a partly sectional view showing a construction of a keyboard musical instrument having applied thereto an apparatus for identifying a key-damper half region according to an embodiment of the present invention, which particularly shows the keyboard musical instrument construction in relation to a given key.

FIG. 1 is a partly sectional view showing a construction of a keyboard musical instrument 30 having applied thereto an apparatus for identifying a half pedal region according to an embodiment of the present invention, which particularly the keyboard musical instrument construction in relation to a given key. The keyboard musical instrument 30 is constructed as an auto-playing piano (player piano). Like an ordinary acoustic piano, the keyboard musical instrument 30 includes, for each of a plurality of keys 31, an action mechanism 33 for transmitting motion of the key 31 to a hammer 32; a string set 34, comprising one or more strings (sounding elements), to be struck by the hammer 32; and a damper 36 for stopping vibrations of the string set 34. Note, however, that such a damper 36 is not provided for keys 31 in a predetermined high pitch range.

A side of the keys 31 closer to a human player will hereinafter referred to as "front". Although it is assumed here that the apparatus fix identifying a half pedal region is incorporated integrally in the keyboard musical instrument 30, the present invention is not so limited, and the apparatus for identifying a half pedal region may be constructed separately from the keyboard musical instrument 30 in such a manner that it can communicate with the keyboard musical instrument 30.

In the keyboard musical instrument 30, a key drive unit 20 including a solenoid 20*a* (FIG. 10) is provided for each of the keys 31 and located beneath a rear end portion of the key 31. Further, a key sensor unit 37 is provided for each of the keys 31 and located beneath a front end portion of the key 31, and the key sensor unit 37 continuously detects a stroke position of the key 31 during depression and release operations of the key 31 to thereby output a detection signal (yk) corresponding to a result of the detection.

A sensor applied to the key sensor unit 37 includes, for example, a light emitting diode (LED), a light sensor for receiving light emitted from the light emitting diode to thereby output a detection signal corresponding to an amount of the received light; and a light blocking plate for changing an amount of light to be received by the light sensor in accordance with a depressed amount of the key 31. The detection signal (yk) which is an analog signal output from the key sensor unit 37 is converted into a digital signal via a not-shown A/D converter and then supplied to a servo controller 42.

Once a drive signal is supplied to the key drive unit 20 of a key corresponding to a sound or tone pitch defined by note-on event data included in performance data, a plunger of the key drive unit 20 ascends to push up a rear end portion of the corresponding key 31. Thus, the key 31 is automatically depressed and the string set 34 corresponding to the depressed key 31 is struck by the hammer 32, so that a piano sound is automatically generated.

The keyboard musical instrument 30 also includes: a pedal PD that is a loud pedal (damper pedal) for driving the dampers 36; a pedal actuator 26 for driving the pedal PD; and a pedal position sensor 27 for detecting a position of the pedal PD. The pedal position sensor 27 may be of a generally similar construction to the sensor applied to the key sensor unit 37. The pedal actuator 26 includes a solenoid 26*a* (FIG. 10) and a plunger (not shown) connected to the pedal PD, and it is constructed in such a manner that, once a drive signal is supplied, the plunger moves to drive the pedal PD so that the pedal PD can be automatically depressed and released.

Except for the predetermined high pitch range, the dampers 36 are provided in corresponding relation to the keys 31. A damper wire 52 is connected to a front portion of the damper lever 51, and the damper 36 is provided on an upper end portion of the damper wire 52. The damper 36 has damper felts FeD (hereinafter referred to as "damper felt FeD") that are provided on its underside and brought into and out of contact with the string set 34. Once the pedal PD is depressed, all of the dampers 36 together move upward or ascend. But, when the pedal PD is not in the depressed state, only the damper 36 corresponding to a depressed key 31 ascends and then descends to its original position in response to release of the corresponding key 31. Namely, the damper 36 is constructed to activate its damping action on the corresponding key 31 (i.e., on vibrations of the string set 34) in response to release of the key 31 and cancel or deactivate its damping action in response to depression of the key 31. Further, the damper pedal PD is constructed to be capable of collectively deactivating or canceling effectiveness of the damping action of the plurality of dampers 36.

Mechanisms related to the dampers 36 may be of the well-known type. As an example, in a region rearward of the key 31, a damper lever 51 is pivotably supported at its rear end portion on a damper lever flange 53 fixed to the keyboard musical instrument 30, a damper wire 52 is connected to a front portion of the damper lever 51. These mechanisms 51, 52, 53, etc. are provided independently for each of the keys 31 for driving the corresponding damper 36. By contrast, the loud pedal PD for collectively driving the dampers 36 of the individual keys 31 and a lifting rail 54 operating in interlocked relation to an operation of the pedal PD are provided for shared use among the individual keys 31. Namely, the single lifting rail 54 extending in a substantially horizontal direction across all of the keys 31 is disposed beneath the damper levers 51 of the individual keys 31. The lifting rail 54 is connected to and supported by the pedal PD via a knot-shown thrust-up rod. As the pedal PD is depressed, the thrust-up rod moves upward, in response to which the lifting rail 54 too moves upward. Then, as the depression of the pedal PD is canceled, the thrust-up rod returns downward, in response to which the lifting rail 54 too returns downward.

A damper lever felt FeP is provided on the upper surface of the lifting rail 54. As the lifting rail 54 moves upward, the damper lever felt FeP drives the damper lever 51, so that the damper lever 51 pivots in a counterclockwise direction of FIG. 1. In this manner, all of the dampers 36 ascend via the damper wires 52, so that all of the damper felts FeD together get out of contact with the corresponding string sets 34. As set forth above in the introductory part of this specification, the single lifting rail 54, moving vertically (in an up-down direction) in interlocked relation to depression of the pedal PD, may not always extend in a complete horizontal direction and there tend to be some variation or unevenness among mechanisms related to the dampers 36 of the individual keys 31, because of which relationship between a depressed position of the pedal PD and operating positions of the dampers 36 of the individual keys 31 (e.g., timing at Which the individual damper felts FeD are brought out of or into contact with the corresponding string sets 34) would differ among the keys 31.

A damper lever cushion felt (hereinafter referred to as "key felt FeK") is provided on an upper rear end portion of the key 31. In a non-key-depressed state, the damper felt FeD is held in abutting contact with the string set 34 by the own weight of the damper 36. Once the key is depressed, the corresponding key felt FeK drives the damper lever 51 so that the damper lever 51 pivots in the counterclockwise direction of FIG. 1. Thus, the corresponding damper 36 ascends via the damper wire 52, so that the damper felt FeD of the damper 36 is brought out of contact with the string set 34.

Further, the keyboard musical instrument 30 may include, for execution of an automatic performance, a piano controller 40, a motion controller 41 and the servo controller 42. The piano controller 40 supplies performance data to the motion controller 41. The performance data comprise, for example, MIDI (Musical Instrument Digital Interface) codes and may include key drive data that specifically defines, for each of the keys 31, time-vs.-position relationship during depression and release strokes of the key 31. The performance data may also include pedal drive data that specifically defines time-vs.-position relationship during a depression stroke of the pedal PD. The motion controller 41 is constructed to generate, on the basis of the pedal drive data and pedal drive data included in the supplied performance data, target position data rp and rk indicative of respective target positions of the shift pedal PD and keys 31 momently changing with respect to time t and supply the generated target position data rp and rk to the servo controller 42. Meanwhile, a detection signal of the pedal position sensor 27 is supplied as a feedback signal yp to the servo controller 42, and similarly a detection signal of the key sensor unit 37 is supplied as a feedback signal yk to the servo controller 42. Note that a signal output from the solenoid 20*a* of the key drive unit 20 may be used as the above-mentioned feedback signal yk.

The servo controller 42 generates, for each of the pedal PD and keys 31, an energizing electric current instructing value up(t), uk(t) corresponding to a deviation between the target position data rp, rk and the feedback signal yp, yk, and it supplies the thus-generated electric current instructing values up(t) and uk(t) to the pedal actuator 26 and the key drive unit 20, respectively. For example, the energizing electric current instructing values up(t) and uk(t) are indicative of average energizing electric currents to be fed to the solenoid coils of the pedal actuator 26 and the key drive unit 20, respectively. Actually, these energizing electric current instructing values up(t) and uk(t) may each be in the form of a PWM signal having been subjected to pulse width modulation in such a manner as to have a duty ratio corresponding to the average energizing electric current.

In an automatic performance based on automatic performance data, the servo controller 42 performs servo control by comparing corresponding ones of the target position data rp and rk and the feedback signals yp and yk and outputting the electric current instructing values up(t) and uk(t) after updating the same as necessary in accordance with deviations between the compared data rp and rk and the feedback signals yp and yk so that the feedback values reach the corresponding target values. In this way, the automatic performance is executed by the shift pedal PD and the keys 31 being driven in accordance with the performance data.

Figure 2:
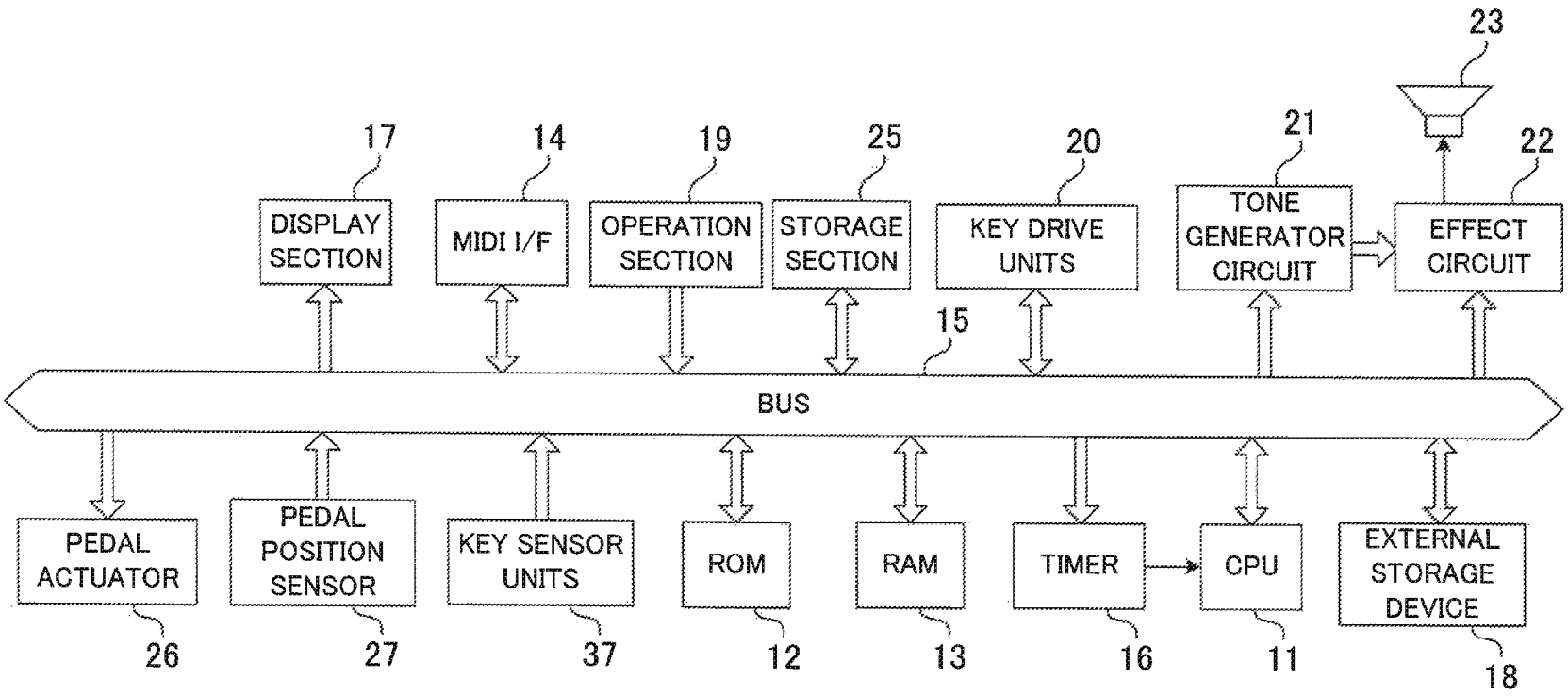
FIG. 2 is a block diagram showing an example hardware construction of a control device of the keyboard musical instrument.

FIG. 2 is a block diagram showing an example hardware construction of a control device for the keyboard musical instrument 30. The control device for the keyboard musical instrument 30 includes a CPU 11 to which are connected, via a bus 15, the aforementioned key drive units 20, the petal actuator 26, the pedal position sensor 27, the key sensor units 37, a ROM 12, a RAM 13, a MIDI interface (MIDI I/F) 14, a timer 16, a display section 17, an external storage device 18, an operation section 19, a tone generator circuit 21, an effect circuit 22 and a storage section 25. A sound system 23 is connected via the effect circuit 22 to the tone generator circuit 21.

The CPU 11 controls the entire keyboard musical instrument 30. The ROM 12 stores therein control programs for execution by the CPU 11 and various data, such as table data. The RAM 13 temporarily stores therein, among other things, various input information, such as performance data and text data, various flags, buffered data and results of arithmetic operations. The MIDI (I/F) 14 inputs, as MIDI signals, performance data transmitted from not-shown MIDI equipment or the like. The timer 16 counts interrupt times in timer interrupt processes and various time lengths. The display section 17 includes, for example, an LCD and displays various information, such as a musical score. The external storage device 18 is constructed to be capable of accessing a not-shown portable storage medium, such as a flexible disk and reading and writing data, such as performance data, from and to the portable storage medium. The operation section 19, which includes not-shown operators (input members) of various types, is operable to instruct a start/stop of an automatic performance, instruct selection of a music piece etc. and make various settings. The storage section 25, which comprises a non-volatile memory, such as a flash memory or hard disk, can store various data, such as performance data. An application program for allowing a computer to execute a method for identifying a damper pedal region in accordance with the embodiment of the present invention is stored in a non-transitory computer-readable storage medium, such as the ROM 12 or storage section 25, and such an application program is executable by the CPU 11.

The tone generator circuit 21 converts performance data into tone signals. The effect circuit 22 imparts various effects to the tone signals input from the tone generator circuit 21, and the sound system 23, which includes a D/A (Digital-to-Analog) converter, amplifier, speaker, etc., converts the tone signals and the like input from the effect circuit 22 into audible sounds.

Note that the functions of the motion controller 41 and the servo controller 42 are actually implemented through cooperation among the CPU 11, timer 16, ROM 12, RAM 13, etc. and application programs.

In a forward stroke of key depression (i.e., key-depressing forward stroke), there exist three different regions: a "play region (or rest region)" where no influence of the key depression is transmitted to the damper 36; a "half region" from a point where reduction of pressing contact of the damper 36 against the string set 34 is started to a point where the damper 37 is brought out of contact with the string set 34; and a "string-releasing region" where, following the above-mentioned half region, the damper 36 is completely spaced away from the string set 34. In a depression stroke of the pedal PD too, there exist three different regions, idle region, half region and string-releasing region.

The half region in relationship between each of the keys 31 and the damper 36 corresponding to the key 31 will hereinafter be referred to as "key-damper half region", while the half region in relationship between the pedal PD and each of the dampers 36 will hereinafter be referred to as "half pedal region". Such a key-damper half region can be defined uniquely per key 31 in relation to stroke positions of the key 31. By contrast, such a half pedal region of the pedal PD can be defined separately or uniquely for each of the keys 31 in relation to the single pedal PD that can commonly act on the dampers 36 of all of the keys 31.

Because the key-damper half region differs subtly from one key 31 to another, it is necessary to identify in advance such a key-damper half region for each of the keys 31 in order to appropriately reproduce half-damper states during an automatic performance etc. However, because this specification does not intend to disclose in detail a method for identifying a key-damper half region for each of the keys 31, it is assumed here that such a key-damper half region for each of the keys 31 has already been identified (measured), and hence that information of a key-damper half region and a half point within the key-damper half region has already been acquired for each of the keys 31. Briefly, the "key-damper half region" can be defined as an operating region where nether effectiveness of the damper 36 or cancellation of the effectiveness of the damper 36 responsive to an operation of the key 31 is sufficient. The "half pedal region", on the other hand, can be briefly defined as an operating region of the pedal PD where neither the effectiveness of the damper 36 nor cancellation of the effectiveness of the damper 36 responsive to an operation of the pedal PD is sufficient.

It should be note that, where the "key-damper half region" is a concept for each of the keys 31, the "half pedal region" when simply referred to means relationship between the single pedal PD and all of the keys 36. However, as noted above, timing at which the individual dampers 36 get out of and into contact with the corresponding string sets 34 differs among the dampers 36 to be exact. Therefore, the start point of the half pedal region as a whole may be considered to exist between a point when the first one of the dampers 36 starts to be driven and a point when the last one of the dampers 36 starts to be driven. Further, the end point of the half pedal region as a whole may be considered to exist between a point when the first one of the dampers 36 releases the string set and a point when the last one of the dampers 36 releases the string set.

In order to realize accurate tuning, it is desirable to accurately identify a half pedal region responsive to an operation of the single pedal PD for each of the dampers 36. Thus, in the instant embodiment, a half pedal region is identified separately for each of the dampers 36 of the keys, as will be described hereinbelow.

FIGS. 3A to 3E are schematic views showing behavior of the key 31 and the damper 36 in the key-depressing forward stroke with the pedal PD in the non-depressed state. FIGS. 4A to 4E are schematic views showing behavior of the lifting rail 54 and the damper 36 in the depressing stroke of the pedal PD (pedal-depressing stroke) in the non-key-depressed state. Main elements which exert resiliency among various elements from the key 31 to the damper 36 are the damper felt FeD provided on the damper 36 and the key felt FeK provided on the key 31. Main elements which exert resiliency among various elements from the pedal PD to the damper 36 are the damper lever felt FeP provided on the lifting rail 54 in addition to the damper felt FeD. Influences of the other elements than the felts FeD, FeK and FeP can be ignored because they are merely nominal.

These damper felt FeD, key felt FeK and damper lever felt FeP can be considered as modeled as linear springs that have their respective predetermined spring constants. To ease visual understanding, FIGS. 3A to 3E and FIGS. 4A to 4E show the damper felt FeD, key felt FeK and damper lever felt FeP in their most expanded state as circular cylindrical blocks (rectangular blocks as viewed in side elevation) and show the damper felt FeD, key felt FeK and damper lever felt FeP in their compressed state as centrally-expanded blocks. Further, the damper lever 51 and the key 31 are assumed to move vertically straight although they pivot as a matter of fact. The same is true for FIGS. 5A to 5E and 6A to 6E.

In order to identify a key-damper half region for each of the key 31, it is preferable that a portion of the key 31 or other element or portion operating in interlocked relation to the key 31 be determined as a particular portion to be used for representing a key stroke position. Although a portion of the key 31 that is normally depressed with a human player's finger may be determined as that particular portion, let it be assumed here for convenience of description that a position on the upper surface of a rear end portion of the key 31 is determined as the particular portion. Thus, let it also be assumed here that the key-damper half region can be expressed as an amount (mm) of displacement in a key-depressing (forward) direction from a rest position (non-key-depressed position) of the particular portion of the key.

Figures 3A, 3B, 3C, 3D, 3E:
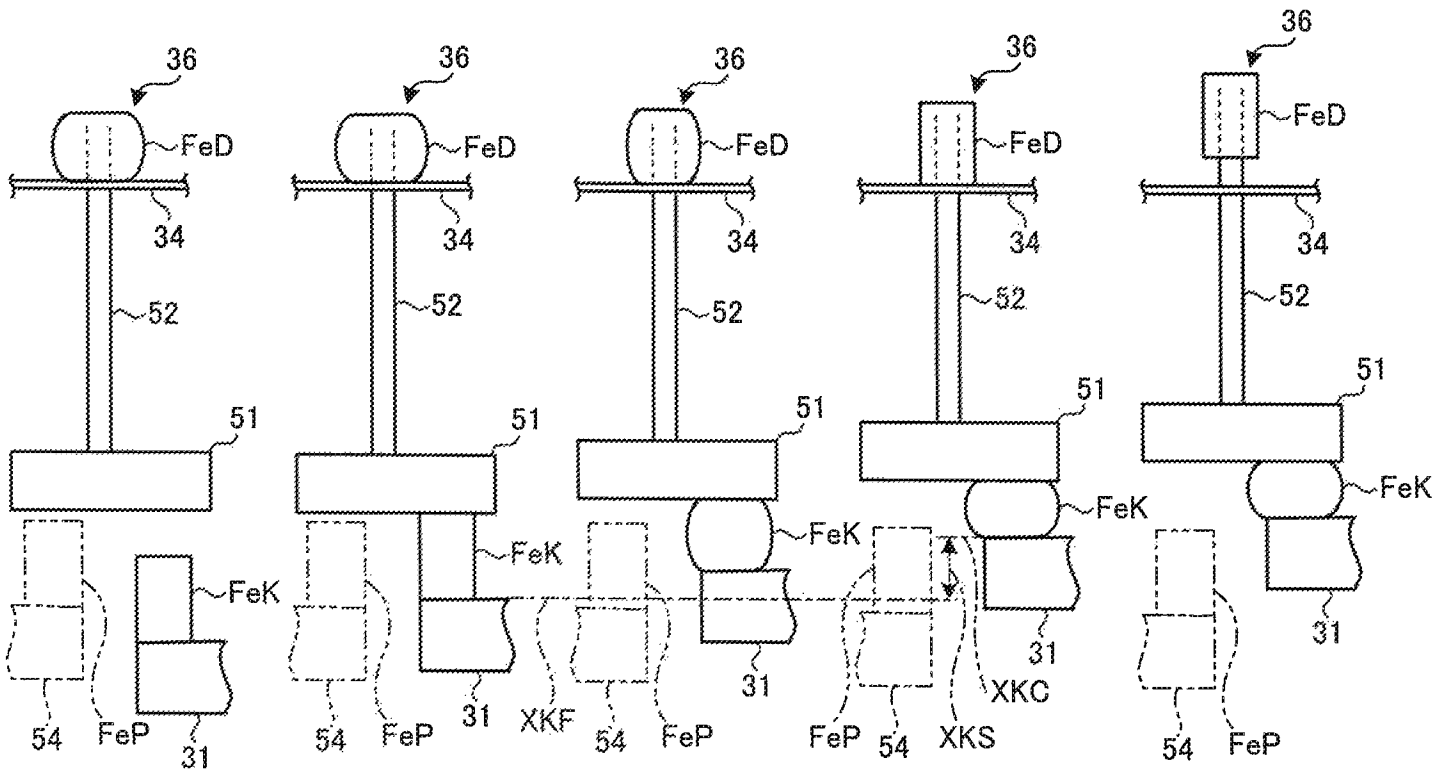
FIGS. 3A to 3E are schematic views showing behavior of a key and a damper in a key-depressing forward stroke with a pedal in a non-depressed state.

First, with reference to FIG. 3, a description will be given about the key-depressing forward stroke with the pedal PD in the non-depressed state. In the non-key-depressed state shown in FIG. 3A, the damper felt FeD is in its most compressed state while the key felt FeK is in its most expanded state. A time point when the key felt FeK abuts against the damper lever 51 as shown in FIG. 3B in response to depression of the key 31 from the non-key-depressed state corresponds to a start point of the key-damper half region (hereinafter referred to as "half region start point XKF". As the key 31 is depressed further, the key felt FeK is compressed and the damper wire 52 ascends together with the damper lever 51, while the compressed state of the damper felt FeD is lessened gradually.

Then, an end point of the key-damper half region (hereinafter referred to as "half region end point XKC"), is reached (FIG. 3D) by way of a half point (FIG. 3C) that is a substantially middle point in the key-damper half region. At this time point, the key felt FeK is in its most compressed state while the damper felt FeD is in its most expanded state as shown in FIG. 3D. Namely, this time point corresponds to a limit (lowermost) position where the damper felt FeD can stay in contact with the string set 34 in the key-depressing forward stroke.

A stroke range from the half region start point XKF (FIG. 3B) to the half region end point XKC (FIG. 3D) is the key-damper half region (hereinafter "key-damper half region XKS"). As the key 31 is depressed further, the damper felt FeD moves upward away from the string set 34 with the felts FeD and FeK maintained in the compressed state, as shown in FIG. 3E. These pieces of information XKF, XKC and XKS related to the key-damper half region may differ among the keys 31, but it is assumed here that such pieces of information XKF, XKC and XKS have been obtained or acquired in advance as noted above.

With focus placed on one of the keys 31 and the corresponding pedal PD, the following describe, with reference to FIG. 4, behavior in a depressing stroke of the pedal PD (pedal-depressing stroke) with the key 31 maintained in the non-key-depressed state.

For identifying a half pedal region, it is preferable that a portion of the pedal PD or other element operating in interlocked relation to the pedal PD be determined in advance as a particular portion to be used for expressing (measuring) a pedal stroke. For example, in the instant embodiment, an upper end portion of the lifting rail 54 is determined as the particular portion. Thus, let it be assumed here that a specific numerical value indicative of the half pedal region is expressed as an amount (mm) of displacement, in the pedal-depressing direction from a rest position (non-pedal-depressed position) of the pedal PD, of the particular portion. Alternatively, however, any other desired portion, such as a distal end portion of the pedal PD, may be determined as the particular portion to be used for expressing (measuring) a pedal stroke. A height position of the particular portion of the pedal PD moved or displaced in response to a depression operation will sometimes be referred to also as "pedal position".

Figures 4A, 4B, 4C, 4D, 4E:
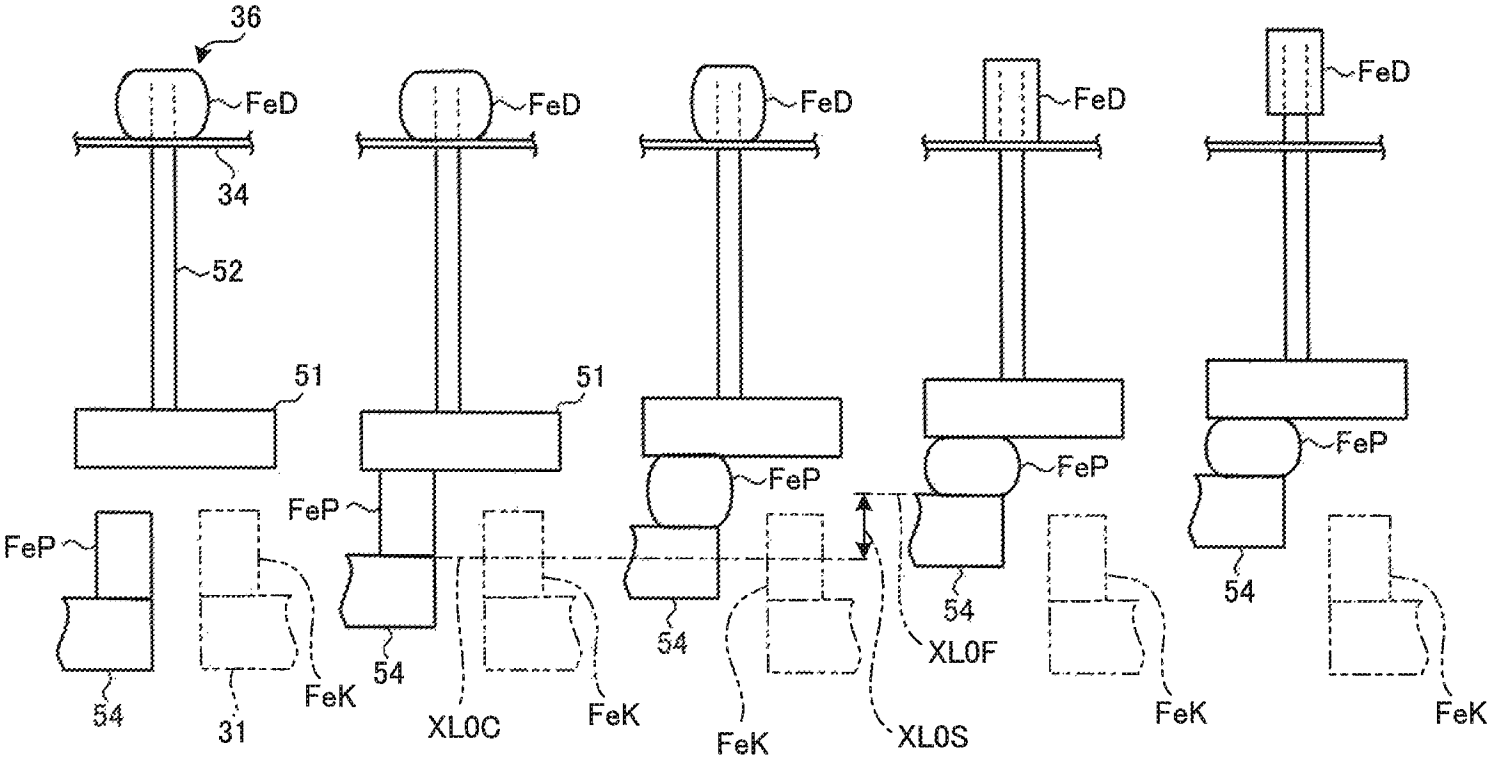
FIGS. 4A to 4E are schematic views showing behavior of a lifting rail and the damper in a pedal-depressing forward stroke in a non-key-depressed state.

In a non-pedal-depressed state shown in FIG. 4A, the damper felt FeD is in the most compressed state while the damper lever felt FeP is in the most expanded state. A time point when the damper felt FeD has abutted against the damper lever 51 as shown in FIG. 4B in response to depression of the pedal PD from the non-pedal-depressed state corresponds to a start point of the half pedal region (hereinafter referred to as "half pedal region start point XL0C"). As the pedal PD is depressed further, the damper wire 52 ascends together with the damper lever 51, so that the damper lever felt FeP compresses while the compressed state of the damper felt FeD is gradually lessened.

Then, an end point of the half pedal region (hereinafter referred to as "half pedal region end point XL0F") is reached (FIG. 4D) by way of a half point (FIG. 4C) that is a substantially middle point in the half pedal region. At this time point, the damper lever felt FeP is in its most compressed state while the damper felt FeD is in its most expanded state. Namely, this time point corresponds to a limit (lowermost) position where the damper felt FeD can stay in contact with the string set 34 in the key-depressing forward stroke. As the pedal PD is depressed further, the damper felt FeD moves upward away from the string set 34 as shown in FIG. 4E with the felts FeD and FeP maintained in their respective compressed/expanded states.

A stroke of the pedal from the half pedal region start point XL0C (FIG. 4B) to the half pedal region end point XL0F (FIG. 4D) is the half pedal region (hereinafter "half pedal region XL0S"). The half pedal region start point XL0C and the half pedal region end point XL0F and hence the half pedal region XL0S is an amount to be identified ultimately in the instant embodiment. Such a half pedal region XL0S can be identified by obtaining or acquiring, for each of the dampers 36 and over one stroke in at least one of depressing and releasing directions of the pedal PD, load information indicative of loads imposed on a portion linked to the damper 36 in association with individual stroke positions of the pedal PD and then acquiring the half pedal region XL based on relationship between the stroke positions of the pedal PD and the imposed loads corresponding to the stroke positions. The portion linked to the damper 36 may be any suitable portion related to the damper lever 51 moving in the up-down direction in interlocked relation to both of vertical movement of the lifting rail 54 responsive to an operation of the pedal PD and an operation of the key 31, or alternatively may be a portion of the key 31 acting on the damper 36. The half pedal region start point XL0C and the half pedal region end point XL0F may be measured directly on the basis of loads imposed on the damper lever 51 by means of a pressure sensor, strain sensor or the like.

However, instead of such a half pedal region start point XL0C and half pedal region end point XL0F being measured directly, a preferred embodiment of the present invention may obtain, for two predetermined half positions (i.e., first key half position XK1 and second key half position XK2), relationship between the stroke positions of the operated pedal PD and loads imposed on the key drive unit 20 with the key 31 kept stationary at a predetermined half position by means of the key drive unit 20. Namely, in the preferred embodiment, loads imposed on the portion of the key 31 acting on the damper 36 (e.g., loads imposed on the key drive unit 20) are measured as loads imposed on the portion linked to the damper 36. Then, on the basis of the obtained relationship, the preferred embodiment calculates the half pedal region start point XL0C and half pedal region end point XL0F defined in relation to the damper 36 of the key 31 in response to the operation of the pedal PD. The following describe, with reference to FIGS. 5A to 5E and 6A to 6E, behavior of various elements related to measurement of the loads.

FIGS. 5A to 5E are schematic diagrams explanatory of behavior of the lifting rail and the damper 36 in the depressing stroke of the pedal PD with the key 31 maintained at the first half position XK1. FIGS. 6A to 6E are schematic diagrams explanatory of behavior of the lifting rail and the damper 36 in the depressing stroke of the pedal PD with the key 31 maintained at the second half position XK2. Although FIGS. 5 and 6 are explanatory of only behavior of the lifting rail 54 and the damper 36 corresponding to one key 31, such behavior of the lifting rail 54 and the damper 36 is the same for the other keys 31.

The first half position XK1 and the second half position XK2 are selectively set from among positions within the key-damper half region XKS except for a rest-position-side end position of the key-damper half region XKS. As an example, let it be assumed here that the second half position XK2 is closer to the depression end than the first half position XK1. In the illustrated example of FIG. 6, the second half position XK2 is set at a depression-end-side end position of the key-damper half region XKS, i.e. set at the half region end point XKC (XK2=XKC).

In initial or first measurement shown in FIGS. 5A to 5E, the key drive unit 20 is servo driven such that feedback control is performed to allow the key 31 to be always located (i.e., to always rest) at the first half position XK1. For the pedal PD, the pedal actuator 26 is driven such that feedback control is performed to allow the pedal PD to move (e.g., slowly at a constant speed) from the non-pedal-depressed position in the depressing direction of the pedal (pedal-depressing direction).

Figures 5A, 5B, 5C, 5D, 5E:
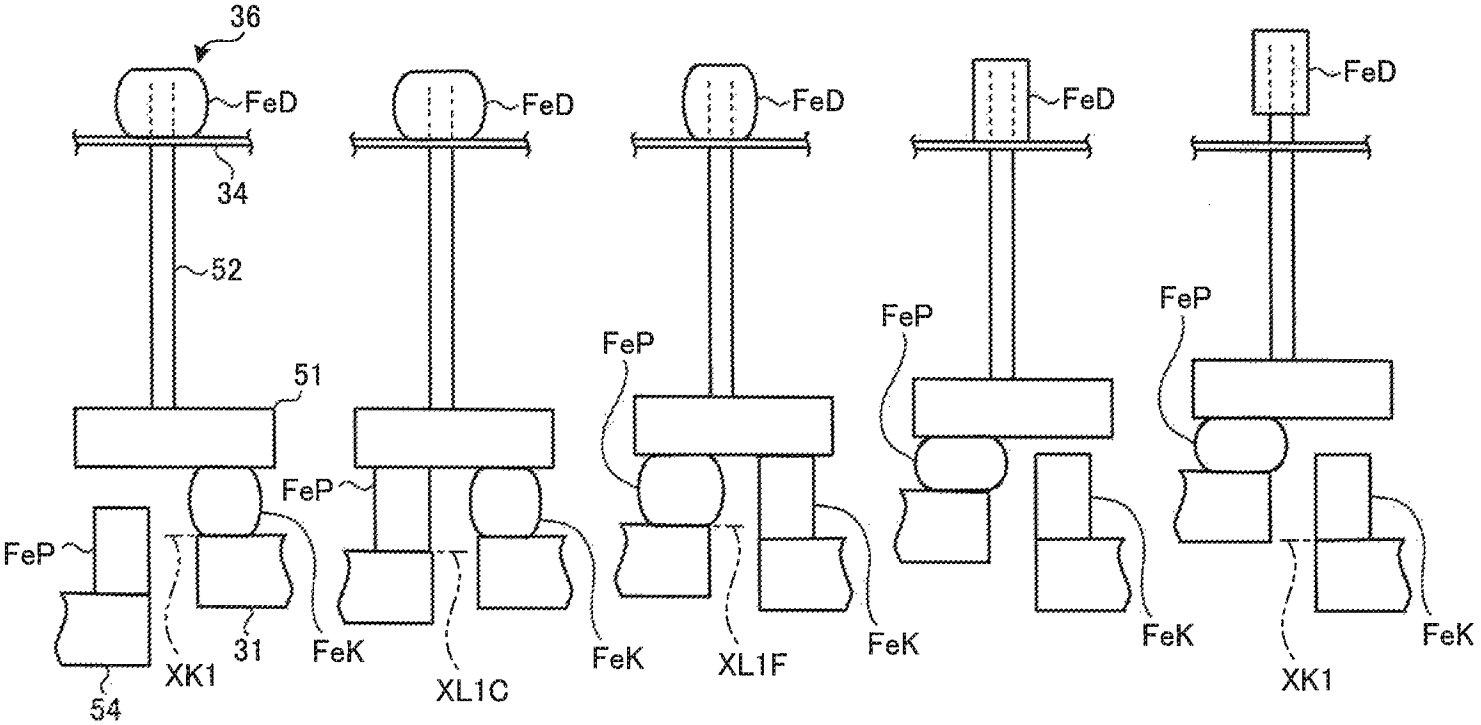
FIGS. 5A to 5E are schematic diagrams explanatory of behavior of the lifting rail and the damper in the pedal-depressing stroke with the key maintained at a first half position.
Figures 6A, 6B, 6C, 6D, 6E:
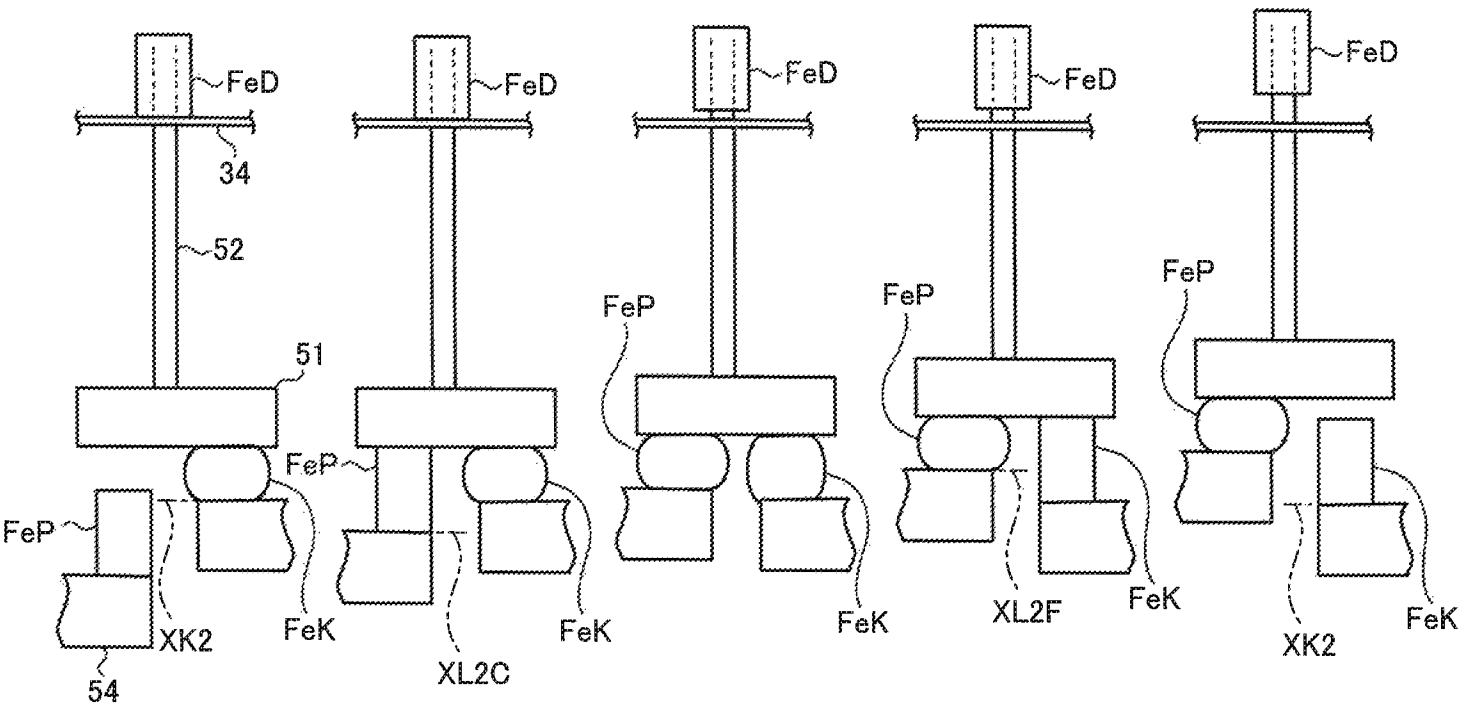
FIGS. 6A to 6E are schematic diagrams explanatory of behavior of the lifting rail and the damper in the pedal-depressing stroke with the key maintained at a second half position.

Because the first half position XK1 is within the key-damper half region XKS, the damper felt FeD and the key felt FeK are both in a slightly-compressed state as shown in FIG. 5A, and the damper lever felt FeP is in the most expanded state. A position of the particular portion of the lifting rail 54 (i.e., pedal stroke position) when the damper lever felt FeP has abutted against the damper lever 51 (FIG. 5B) in response to displacement, in a forward direction (i.e., depressing direction), of the pedal PD corresponds to a pedal position XL1C.

As the pedal PD is displaced further in the forward direction, the damper wire 52 ascends together with the damper lever 51, so that the damper lever felt FeP compresses while the compressed state of the damper felt FeD is gradually lessened. During that time, the key 31 is maintained in position, and thus, the compressed state of the key felt FeK too is gradually lessened.

A pedal stroke position at a time point when the key felt FeK has been brought to the most expanded state (FIG. 5C) is a pedal position XL1F. As the pedal PD is displaced further from the pedal position XL1F, the damper lever felt FeP compresses further, and the compressed state of the damper felt FeD is lessened further. Because the key felt FeK gets away from the damper lever 51, it stays in the most expanded state.

Then, the damper lever felt FeP is brought into the most compressed state while the damper felt FeD is brought into the most expanded state, as shown in FIG. 5D. Namely, this time point corresponds to a limit (lowermost) position where the damper felt FeD can stay in contact with the string set 34 in the forward stroke of the pedal PD. As the pedal PD is displaced further, the damper felt FeD moves upward away from the string set 34 with the expanded state of the felts FeD and FeP remaining unchanged, as shown in FIG. 5E.

In second measurement shown in FIGS. 6A to 6E, the key drive unit 20 is servo driven such that feedback control is performed to allow the key 31 to be always located (i.e., to always rest) at the second half position XK2. Stroke drive control for the pedal PD may be performed slowly at a constant speed in the same manner as in the first measurement.

Because the second half position XK2 is a depression-end-side end position of the key-damper half region XKS, the damper felt FeD is in the most expanded state and the key felt FeK is in the most compressed state, as shown in FIG. 6A, when the key 31 is at the second half position X. Then, the damper lever felt FeP is also in the most expanded state. A pedal stroke position at a time point when the damper lever felt FeP has abutted against the damper lever 51 in response to further displacement, in the forward direction, of the pedal PD (FIG. 6B) is a position XL2C. This time point corresponds to a limit (lowermost) position where the damper felt FeD can stay in contact with the string set 34 in the forward stroke of the pedal PD.

As the pedal PD is displaced further in the forward direction, the damper wire 52 ascends together with the damper lever 51, so that the damper lever felt FeP compresses and the damper felt FeD moves upward away from the string set 34 while remaining in the expanded state, as shown in FIG. 6C. During that time, the key 31 is maintained in position, and thus, the compressed state of the key felt FeK is gradually lessened.

A pedal stroke position at a time point when the key felt FeK has been brought to the most expanded state (FIG. 6D) is a pedal position XL2F. At this time point, the damper lever felt FeP is brought into the most compressed state. As the pedal PD is displaced further following that time point, the damper felt FeD moves upward away from the string set 34 with the expanded state of the felts FeD and FeP remaining unchanged, as shown in FIG. 6E. Because the key felt FeK gets away from the damper lever 51, it remains in the most expanded state.

FIGS. 7A to 7C are conceptual diagrams showing a method for identifying a half pedal region XL02 in modeled representations. Meanings and explanations of various symbols used in FIGS. 7A to 7C are shown as explanatory notes, where "springs" represent the felts FeD, FeP and FeK that are resilient members.

FIG. 7A shows a model in which a position of the key 31 does not influence the corresponding damper 36 and in which the damper 36 is controlled only by movement of the pedal PD (i.e., in which the key 31 imposes no load on the damper 36 or the load imposed by the key 31 on the damper is zero). This model corresponds to FIGS. 4A to 4E. Such a state in which the key 31 imposes no load on the damper 36 is, in other words, a state where the key 31 is maintained at the half region start point XKF or at a position closer to the rest position than the half region start point XKF. The half pedal region XL0S of the pedal PD to be identified in accordance with the present invention is a half region that occurs when the pedal PD has been depressed in the state where the load imposed by the key 31 on the damper is zero, i.e. a half region that is based only on an operation of the pedal PD. The half pedal region start point XL0C is a pedal stroke position at a time point when the damper lever felt FeP starts compressing, while the half pedal region end point XL0F is a pedal stroke position at a time point when the damper lever felt FeP is in the most compressed state (see also FIGS. 4B and 4D). If these start point XL0C and end point XL0F can be identified, then the half pedal region XL0S can also be identified. However, because the instant embodiment measures a load imposed on the key drive unit 20 in order to efficiently measure a load imposed on the damper 36, it cannot obtain effective measurements in the state where the load imposed by the key 31 on the damper 36 is zero, and thus, the start and end points XL0C and XL0F cannot be measured directly. For this reason, the instant embodiment is arranged to perform the aforementioned first measurement (FIGS. 5A to 5E) and second measurement (FIGS. 6A to 6E) in a state where there is a load imposed by the key 31 on the damper 36 and then detect the start and end points XL0C and XL0F on the basis of such first and second measurement to thereby identify the half pedal region XL0S.

In FIG. 7A, positions XDF and XDC are shown as one of various factors related to the damper 36. Such positions XDF and XDC also relate to the key-damper half region, and thus, the following first describe the positions XDF and XDC in relation to the key-damper half region. These positions XDF and XDC represents upper end positions (as viewed in FIG. 3) of the damper felt FeD corresponding to the half region start point XKF and half region end point XKC of the key 31. The position XDF corresponding to the state of FIG. 3B is a position where the damper felt FeD is in abutting engagement with the stationary member (string set 34) in its most compressed state. As the key 31 is depressed further from the position XDF, the damper lever 51 is pushed up gradually, so that the damper felt FeD expands gradually. The position XDC corresponding to the state of FIG. 3D is a position where the damper felt FeD is in abutting engagement with the stationary member (string set 34) in its most expanded state. As the key 31 is depressed further from the position XDC, the damper lever 51 is pushed up with the damper felt FeD kept in the most expanded state, so that the damper felt FeD can be reliably moved away from the string set 34. A difference XDS between the position XDF and the position XDC (XDS=XDC−XDF) represents an expansion/compression amount when the damper felt FeD is considered alone or independently.

The expansion/compression amount XDS of the damper felt FeD related to the key-damper half region applies also to the half pedal region XL0S, i.e. the range from the half pedal region start point XL0C to the half pedal region end point XL0F. Namely, the position XDF of the damper felt FeD corresponds to the state of FIG. 4B, and the position XDC of the damper felt FeD corresponds to the state of FIG. 4D.

Further, an expansion amount (or compression amount) of the damper felt FeD in the range from the half pedal region start point XL0C to the half pedal region end point XL0F is also the amount XDS.

FIG. 7B shows a model in the first measurement where the key 31 is maintained at the above-mentioned first position XK1 (see also FIGS. 5A to 5E). FIG. 7C shows a model in the second measurement where the key 31 is maintained at the above-mentioned second position XK2 (see also FIGS. 6A to 6E).

In the first measurement shown in FIG. 7B, the pedal PD is depressed with the key maintained at the above-mentioned first position XK1, during which time loads on the key drive unit 20 corresponding to individual pedal stroke positions are measured. Then, the required pedal positions XL1C and XL1F are extracted from a load characteristic curve (FIG. 9) that represents a trajectory of the measured loads. The pedal position XL1C to be extracted here is a pedal position at a time point when the damper lever felt FeP starts compressing (FIG. 5B), while the pedal position XL1F is a pedal position at a time point when the key felt FeK has expanded most (FIG. 5C).

In the second measurement shown in FIG. 7C, the pedal PD is depressed with the key 31 maintained at the above-mentioned second position XK2, during which time loads on the key drive unit 20 corresponding to individual pedal stroke positions are measured. Then, the required pedal positions XL2C and XL2F are extracted from a load characteristic curve (FIG. 9) that represents a trajectory of the measured loads. The pedal position XL2C to be extracted here is a pedal position at a time point when the damper lever felt FeP starts compressing (FIG. 6B), while the pedal position XL2F is a pedal position at a time point when the key felt FeK has compressed most (FIG. 6D).

If R is assumed to be a given value less than one, such as 0.5 (R=0.5), then the first position XK1 in the first measurement can be expressed as XK1=XKF+R*XKS. Further, because the region from the half region start point XKF to the half region end point XKC is the key-damper half region XKS, "XKS=XKC−XKF" is established. Because the position XK2 is set at the half region end point XKC (XK2=XKC) in the second measurement, "XK2=XKF+XKS" is established.

Figure 8:
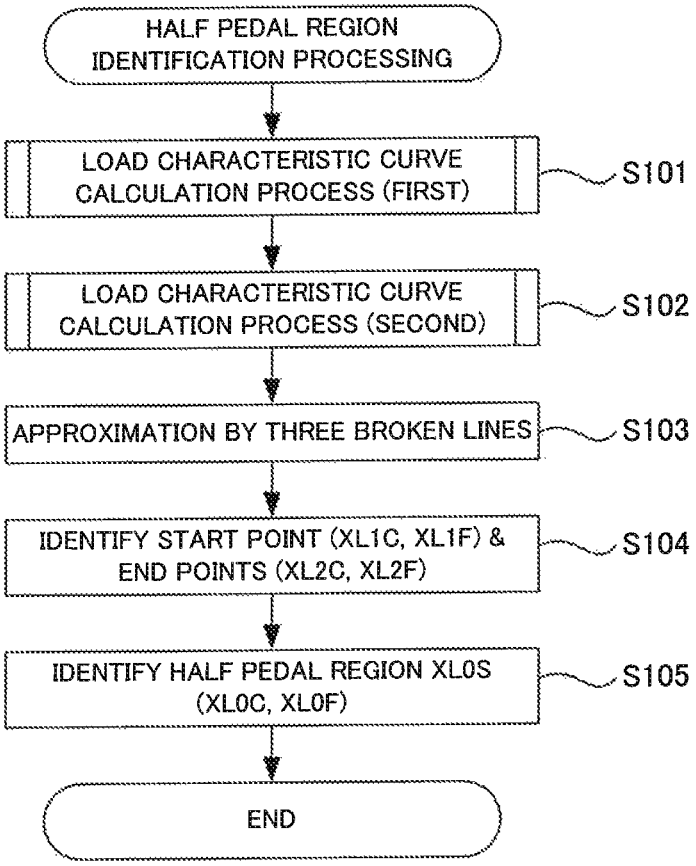
FIG. 8 is a flow chart showing an operational sequence of half pedal region identification processing for identifying a half pedal region for each of the keys (dampers)

FIG. 8 is a flow chart showing an operational sequence of half pedal region identification processing for identifying a half pedal region for each of the keys 31 (dampers 36). Such half pedal region identification processing of FIG. 8 is performed by the CPU 11 for each of the keys 31.

First, at step S101 (first acquisition step), the CPU 11 performs a load characteristic curve calculation process based on the first measurement shown in FIGS. 5A to 5E. Then, at step S102 (second acquisition step), the CPU 11 performs a load characteristic curve calculation process based on the second measurement shown in FIGS. 6A to 6E. As will be described later with reference to FIG. 11, these load characteristic curve calculation processes are each a process for obtaining or acquiring a load characteristic curve CA indicative of loads on the key drive unit 20 corresponding to stroke positions of the pedal PD when the pedal PD has been driven in the pedal-depressing direction. The only difference between the first measurement and the second measurement is whether the position where the key 31 should rest is the first position XK1 or the second position XK2.

Figure 9:
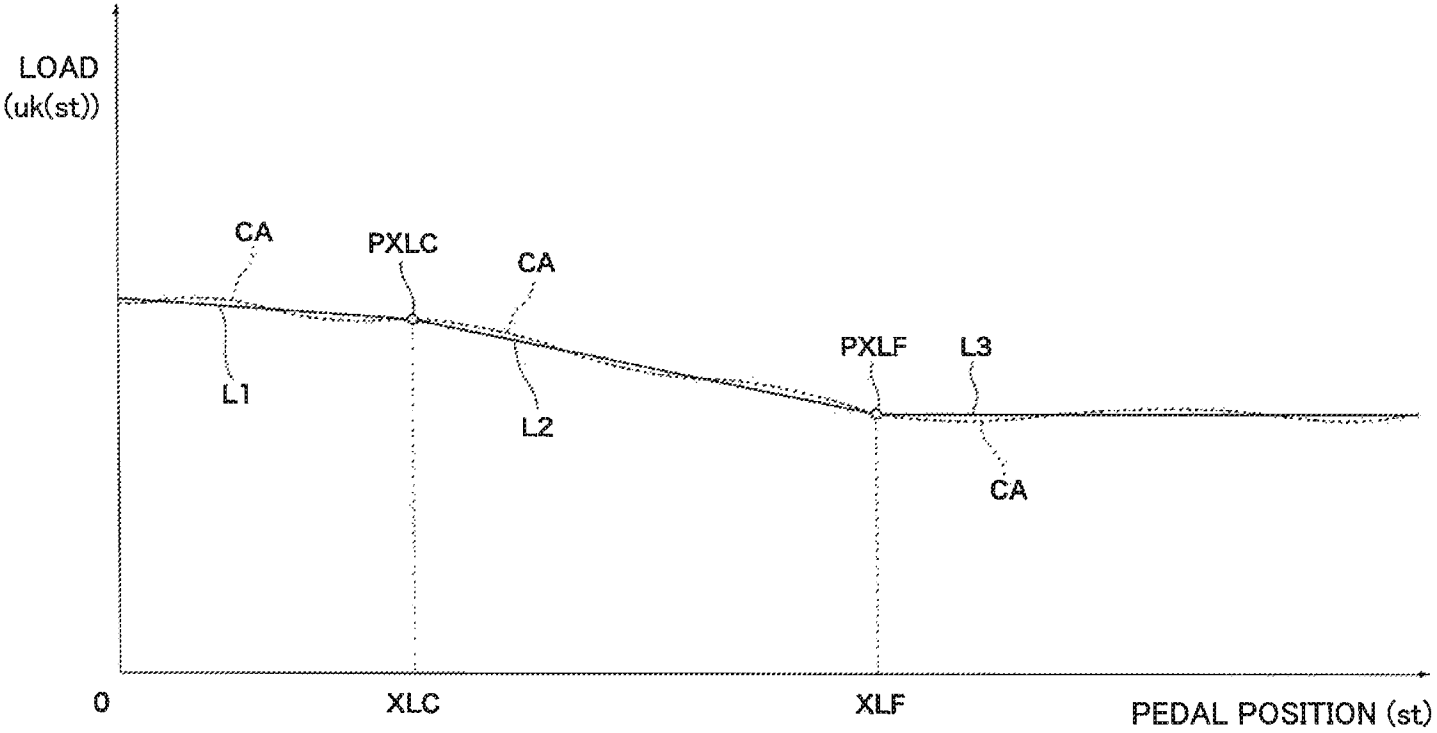
FIG. 9 is a diagram showing a load characteristic curve and approximate straight lines of the load characteristic curve.

FIG. 9 is a diagram showing the load characteristic curve CA and approximate straight lines L1 to L3 of the load characteristic curve CA. In FIG. 9, the horizontal axis represents stroke positions st of the pedal PD corresponding to various amounts of depression from the non-pedal-depressed position, while the vertical axis represents loads imposed on the key drive unit 20 (later-described electric current instructing values uk(st)). Note that the loads imposed on the key drive unit 20 are equivalent to loads imposed on a portion of the key 31 acting on the damper 36. Here, the portion of the key 31 acting on the damper 36 is, for example, a portion of the key 31 which the solenoid 20*a* of the key drive unit 20 abuts against, or the key felt FeK and a portion of the key 31 having the key felt FeK provided thereon, or a portion of the damper lever 51 which the key felt FeK abuts against.

Figure 10:
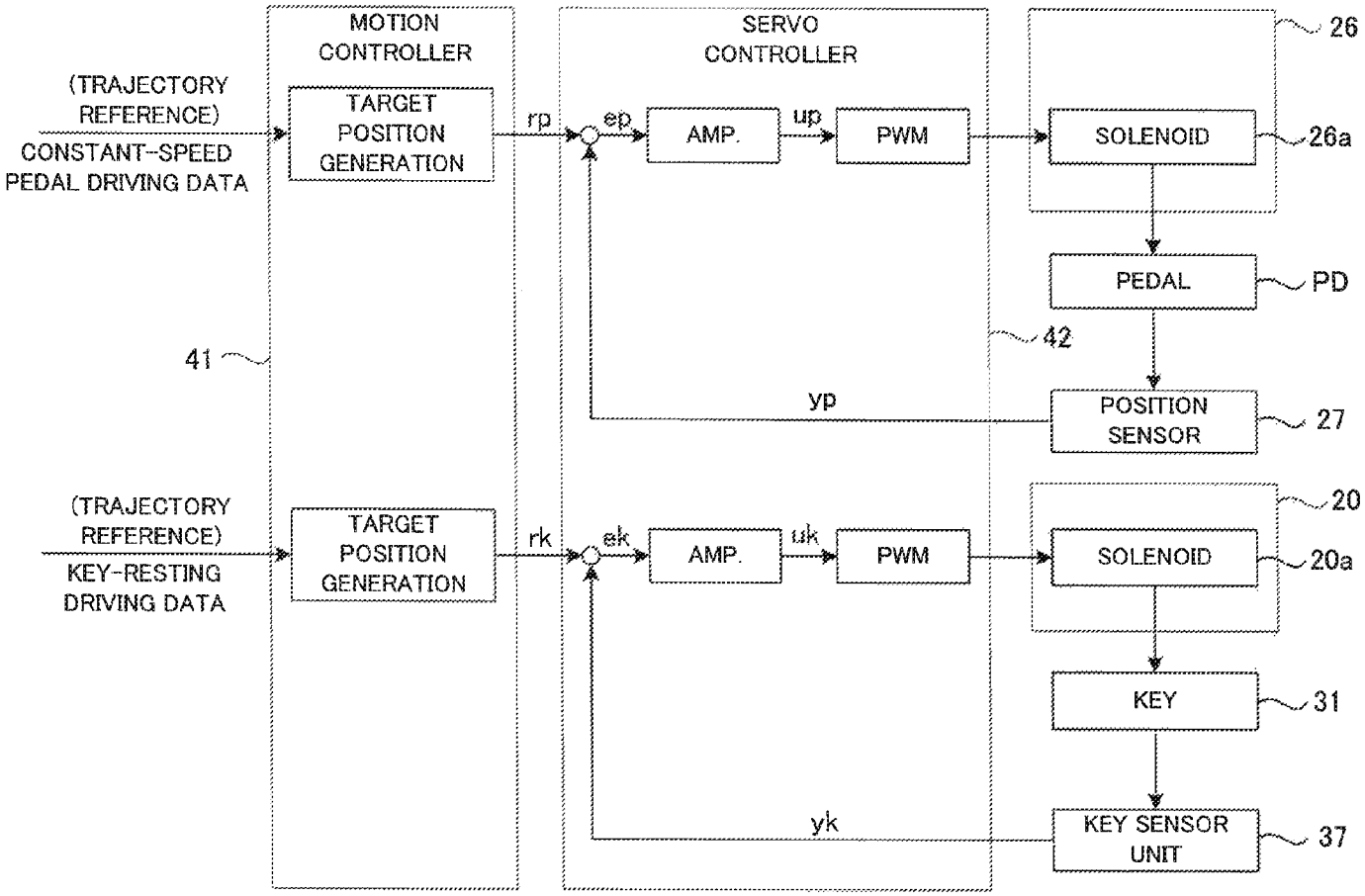
FIG. 10 is a block diagram showing data and control flows involved in servo drive for a load characteristic curve calculation process.
Figure 11:
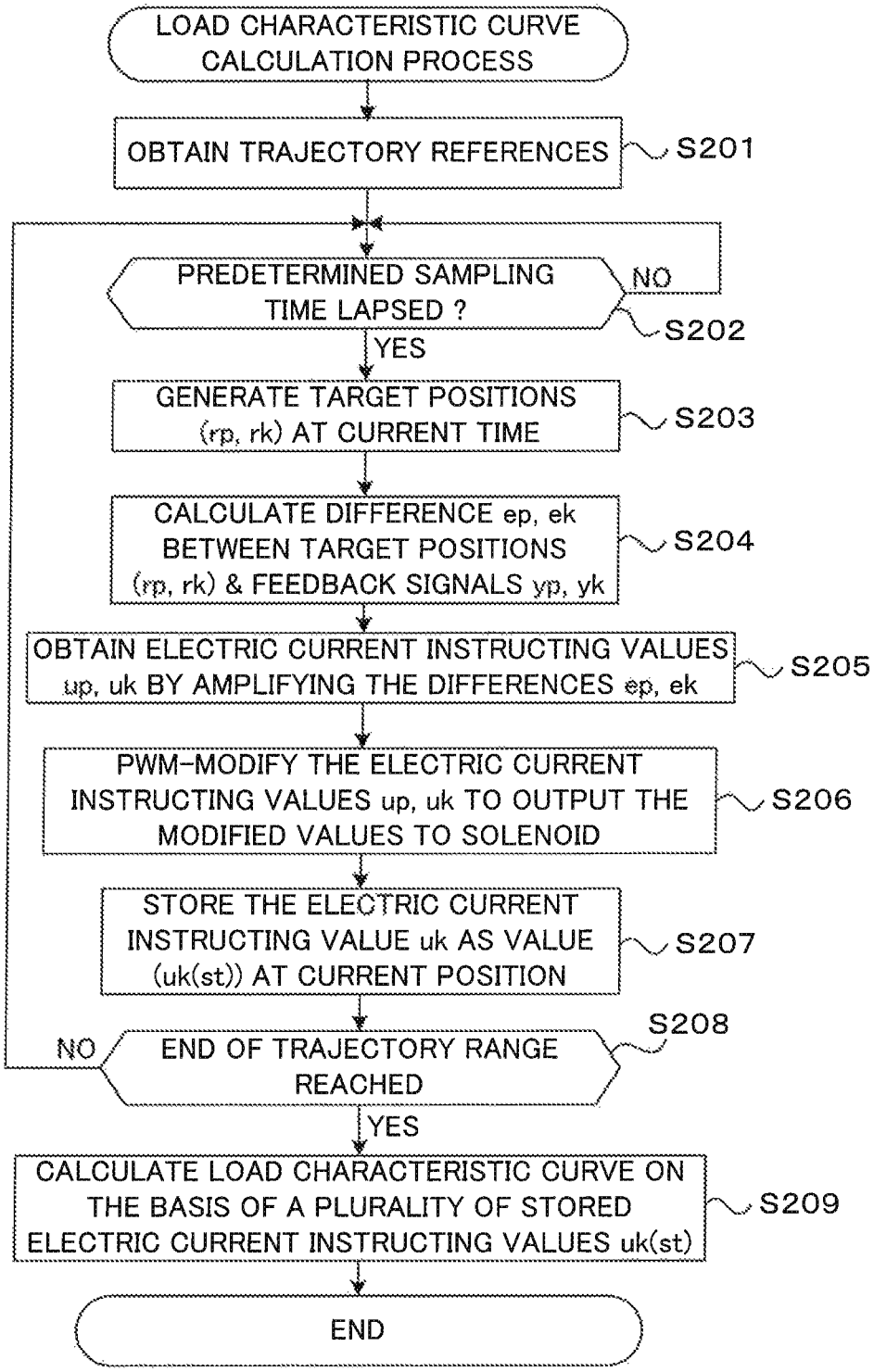
FIG. 11 is a flow chart showing an example operational sequence of the load characteristic curve calculation process in the half pedal region identification processing of FIG. 8.

FIG. 10 is a block diagram showing data and control flows involved in servo drive for the load characteristic curve calculation process, and FIG. 11 is a flow chart showing an example operational sequence of the load characteristic curve calculation process performed at step S101, S102 of the processing of FIG. 8.

According to the instant embodiment, "constant-speed pedal driving data" for driving the pedal PD at a substantially constant speed is prepared in advance. Further, "key-resting driving data" for resting the key 31 at the first position XK1 and second position XK2 is prepared in advance. Like the above-mentioned performance data, these driving data are supplied from the piano controller 40 to the motion controller 41, so that target position data corresponding to each of the driving data is supplied to the servo controller 42.

In turn, the servo controller 42 performs feedback control to supply the solenoid 26*a* of the pedal actuator 26 with an electric current instructing value up(t) (such an electric current instructing value up(t) will hereinafter be referred to particularly as "electric current instructing value up(st)") based on the target position data corresponding to the constant-speed pedal driving data. Thus, the pedal PD is driven by the pedal actuator 26 to move in the pedal-depressing direction at a substantially constant speed.

In parallel with the above, the servo controller 42 also performs feedback control to supply the solenoid 20*a* of the key drive unit 20 with an electric current instructing value uk(t) (such an electric current instructing value uk(t) will hereinafter be referred to particularly as "electric current instructing value uk(st)") based on the target position data corresponding to the key-resting driving data. Although the load imposed by the damper 36 on the key 31 varies momently in response to movement of the pedal PD, the key 31 receives from the key drive unit 20 driving force corresponding to the variation, so that the key 31 can always rest at generally the same position (i.e., first position MO in the first measurement).

Referring now to FIGS. 10 and 11, first, the motion controller 41 obtains trajectory references based on the constant-speed pedal driving data and key-resting driving data, respectively, at step S201. Then, upon lapse of a predetermined sampling time (e.g., 4 msec) (step S202), the motion controller 41 generates target positions of the pedal PD and the key 31 (i.e., target position data rp and target position data rk) corresponding to a current time t and outputs the thus-generated target positions to the servo controller 42 at step S203.

Then, at step S204, the servo controller 42 receives feedback signals yp and yk from the pedal position sensor 27 and key sensor unit 37 and calculates differences ep and ek between corresponding ones of the target position data rp and rk output from the motion controller 41 and the feedback signals yp and yk.

Then, the servo controller 42 amplifies the differences ep and ek to provide electric current instructing values up and uk at step S205 and PWM-modifies the electric current instructing values up and uk to output the PWM-modified electric current instructing values up and uk to the solenoid 26*a* of the pedal actuator 26 and the solenoid 20*a* of the key drive unit 20, respectively, at step S206. Thus, the pedal PD and the key 31 are driven, and positions st of the pedal PD and the key 31 are detected by the pedal position sensor 27 and the key sensor unit 37 and fed back to the servo controller 42 as feedback signals yp and yk.

Then, at step S207, the servo controller 42 stores into a storage device, such as the RAM 13, the output electric current instructing value uk as a value at the current position, i.e. as an electric current instructing value uk(st) corresponding to the stroke position st of the key 31 indicated by the current feedback signal yk. Then, the aforementioned operations of steps S202 to S207 are repeated until an end of the trajectory range is reached as determined at step S208. Finally, a load characteristic curve CA is calculated at step S209 on the basis of a plurality of electric current instructing values uk(st) stored in the storage device, after which the load characteristic curve calculation process of FIG. 11 is brought to an end.

Alternatively, the aforementioned load characteristic curve calculation process may be performed a plurality of times (e.g., ten times) to thereby store a plurality of pieces of load information (electric current instructing values uk(st)) for the same target position. As another alternative, an average of the plurality of pieces of load information obtained for the same target position may be calculated, and the thus-calculated average may be set as the electric current instructing value uk(st).

Further, in the instant embodiment, the position st of the pedal PD represents a value based on the feedback signal yp that is a detection signal of the pedal position sensor 27. Further, the load imposed on the key drive unit 20 represented on the vertical axis represents the electric current instructing value uk(st) that is output from the servo controller 42 in the process of FIG. 11. The load characteristic curve CA of FIG. 9 indicates variation of the electric current instructing values uk(st) versus the positions st of the pedal PD when the pedal PD is driven at a substantially constant slow speed.

Note that the process of FIG. 11 has been described as measuring loads imposed on the key drive unit 20 while moving the pedal PD in the pedal-depressing direction (forward stroke direction). However, the present invention is not so limited. For example, as an alternative, a mechanism for controlling movement of the pedal PD in a returning stroke direction (releasing direction of the pedal PD or pedal-releasing direction) may be provided so that the process of FIG. 11 can measure loads imposed on the key drive unit 20 while moving the pedal PD in the returning stroke direction. As another alternative, a single load characteristic curve CA may be obtained, for example, by averaging two curves obtained from movement of the pedal PD in both of the pedal-depressing forward stroke direction and pedal-releasing returning stroke direction.

Next, at step S103 of FIG. 8, the CPU 11 performs a straight line approximation operation for approximating each of the load characteristic curves CA, obtained at steps S101 and S102 above, by three broken lines. As a consequence, the load characteristic curve CA is approximated by the first to third straight lines L1 to L3 as shown in FIG. 9. In FIG. 9, pXLC indicates an intersection point (bending point) between the first straight line L1 and the second straight line L2, and pXLF indicates an intersection point (bending point) between the second straight line L2 and the third straight line L3. Namely, the intersection points pXLC and pXLF represent two sudden change points Where the load characteristic curve CA suddenly changes in inclination. More specifically, the sudden change points of the load characteristic curve CA obtained in the first measurement are first two sudden change points, and the sudden change points of the load characteristic curve CA obtained in the second measurement are second two sudden change points.

Next, at step S104 of FIG. 8, pedal stroke positions corresponding to the bending points pXLC and pXLF are identified as a start point XLC and an end point XLF, respectively. Such start and end points XLC and XLF identified from the load characteristic curve CA obtained in the first measurement are the above-mentioned pedal position XL1C (FIG. 5B) and pedal position XL1F (FIG. 5C), respectively. Similarly, such start and end points XLC and XLF identified from the load characteristic curve CA in the second measurement are the above-mentioned pedal position XL2C (FIG. 6B) and pedal position XL2F (FIG. 6D), respectively.

Then, at step S105 (identification step) of FIG. 8, the half pedal region start point XL0C and the half pedal region end point XL0F are identified, in accordance with the following algorithm, on the basis of the pedal positions XL1C, XL1F, XL2C and XL2F measured in the aforementioned manner as well as the expansion/compression amount XDS (when the damper felt FeD is considered alone) and the already-acquired key-damper half region XKS.

In FIGS. 7A to 7C, focus is placed on the expansion/compression amount XDS and the pedal positions XL1C and XL2C. Because a state of the damper felt FeD corresponding to the pedal position XL2C is the most expanded state, that position can be expressed as the expansion/compression amount XDS. Further, a position of the damper felt FeD corresponding to the pedal position XL1C can be expressed as R*XDS. Further, in either case, the damper lever felt FeP contacts the damper lever 51 in its most expanded state (see also FIGS. 5B and 6B), and thus, a difference between the pedal positions XL2C and XL1C corresponds to a difference between the expansion/compression amount XDS and above-mentioned R*XDS, so that "XL2C−XL1C=(1−R)*XDS" is established. Thus, the expansion/compression amount XDS can be obtained from an equation "XDS=(XL2C−XL1C)/(1−R)".

Next, with the focus placed on the expansion/compression amount XDS and the pedal positions XL1C and XL2C, the half pedal region start point XL0C can be calculated by "XL0C=XL1L−R*XDS=XL2C−XDS". Further, with the focus placed on the key-damper half region XKS, the expansion/compression amount XDS and the pedal positions XL1F and XL2F, the half pedal region end point XL0F can be calculated by an equation "XL0F=XL1F−(R*XKS−XDS)=XL2F−(XKS−XDS)".

With the half pedal region start point XL0C and the half pedal region end point XL0F identified in the aforementioned manner, the half pedal region XL0S can be identified. After that, the half pedal region identification processing of FIG. 8 is brought to an end.

Figure 12:
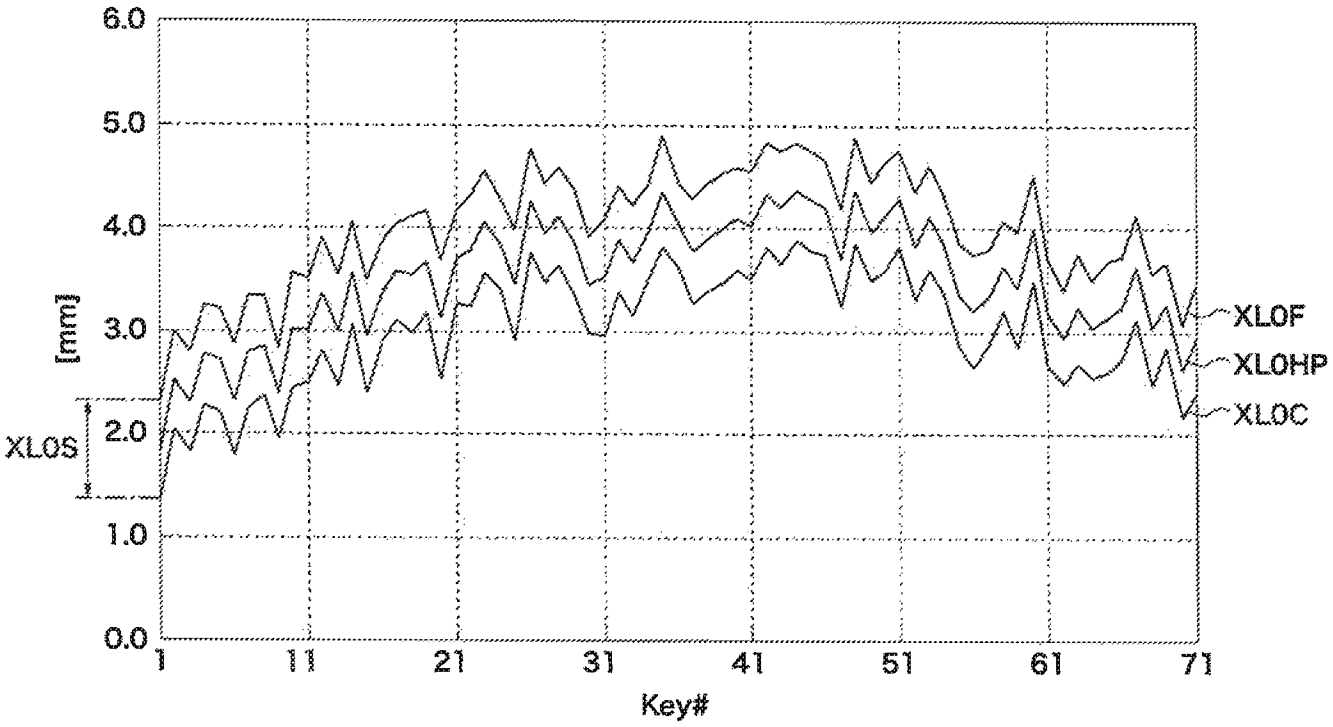
FIG. 12 is a diagram showing distribution of half pedal regions for the individual dampers.

FIG. 12 is a diagram showing distribution of half pedal regions XL0S for the individual dampers 36 of the keys 31, where the horizontal axis represents key numbers of the individual keys 31 while the vertical axis represents the pedal stroke positions (mm).

The half pedal region identification processing of FIG. 8 is performed for each of the keys 31, so that a half pedal region start point XL0C and a half pedal region end point XL0F and hence a half pedal region XL0S can be obtained for each of the dampers 36.

Further, according to the instant embodiment, a half point XL0HP in the half pedal region XL0S is determined on the basis of the half pedal region start point XL0C and the half pedal region end point XL0F. As an example, a point at which a segment from the half pedal region start point XL0C to the half pedal region end point XL0F is divided in accordance with a predetermined internal division ratio is set or determined as the half point XL0HP. In the instant embodiment, "1:1" is employed as the predetermined internal division ratio, and thus, a half point XL0HP is determined for each of the keys 31 (dampers 36) as shown in FIG. 12.

Because the half point HP is determined on the basis of the internal division ratio between the points XL0C and XL0F identified by the straight line approximation of the load characteristic curve CA, the instant embodiment can identity the half point XL0HP accurately and easily. Additionally, because the load characteristic curve CA is obtained as a result of driving the pedal PD at a substantially constant slow speed, the half region start point XL0C and the half region end point XL0F can be identified with a high accuracy.

Note that the internal division ratio is not necessarily limited to "1:1" and may be set at an appropriate value evaluated in advance by experiment or the like depending, for example, on the type of the keyboard musical instrument; such an appropriate value differs between upright pianos and grand pianos.

The instant embodiment is arranged to obtain or acquire a load characteristic curve CA representative of relationship between stroke positions of the pedal PD and loads imposed on the key drive unit 20 when the pedal PD has been moved with the key 31 controlled to rest at a predetermined position within the key-damper half region XKS except for a rest-position-side end position of the key-damper half region XKS. Such load characteristic curve acquisition is performed for two predetermined positions. Thus, for each of the keys 31, it is possible to accurately identify a half pedal region XL0S on the basis of two sudden points (i.e., intersection points pXLC and pXLF) at which the load characteristic curve CA suddenly changes in inclination.

Note that, whereas the half pedal region identification processing of FIG. 8 has been described as performed separately for each of the keys 31, it may be performed collectively for a plurality of the keys 31. In such a case, the half pedal region identification processing of FIG. 8 is performed collectively for individual ones of the keys 31 so that half pedal regions XL0S for the plurality of the keys 31 can be identified collectively.

Further, the order in which first measurement and the second measurement is performed may be reversed from the aforementioned.

Note that the driving of the pedal PD for obtaining the load characteristic curve CA may be executed in any desired manner as long as the pedal PD is controlled to be always positioned at a target position. Therefore, the means for driving the pedal PD is not necessarily limited to the pedal actuator 26. Further, the construction for controlling the driving of the pedal PD to be always positioned at a target position is also not limited to the control performed by the motion controller 41, servo controller 42 etc. using the constant-speed driving data, and the pedal PD may be operated manually (by a foot).

Further, the present invention is not limited to the measurement of the load characteristic curve CA based on the aforementioned dynamic driving and may obtain the load characteristic curve CA through static or quasi-static driving. For example, the present invention may be arranged to obtain the load characteristic curve CA by plotting electric current instructing values uk(st) output for maintaining a static state of the key 31 at individual ones of a plurality of positions of the pedal PD.

Further, whereas, in the load characteristic curve CA (FIG. 9), detection signals of the pedal position sensor 27, i.e. measured values of stroke positions, are employed as the values to be represented on the horizontal axis, the present invention is not so limited, and target values or instructing values rather than the measured values may be used as information indicative of the stroke positions of the pedal PD; for example, the information indicative of the stroke positions of the pedal PD may be MIDI values (such as depression depth values) defining operation or movement of the pedal PD. As another alternative, thrust force of the solenoid may be calculated on the basis of the information of the electric current instructing values uk(st) and positions st of the key 31 and previously-examined thrust force characteristic of the solenoid, and the thus-calculated thrust force may be used as the load information.

Further, the values to be represented on the vertical axis in the load characteristic curve CA are not limited to electric current instructing values uk(st) of the key drive unit 20 as long as they are load information indicative of loads imposed on the portion of the key 31 acting on the damper 36. For example, physical information corresponding to loads, such as solenoid coil currents, may be observed, and observed values of such physical information may be used as the values to be represented on the vertical axis. Alternatively, a pressure sensor or strain sensor may be provided on a portion related to the above-mentioned portion of the key 31 acting on the damper 36, so as to directly detect loads imposed on the acting portion.

Furthermore, the load information related to the damper 36 of each of the keys 31 during the depressing stroke of the pedal PD may be detected or measured from another damper-related portion than the portion of the key 31 acting on the damper 36. For example, a pressure sensor or strain sensor may be provided on a suitable portion related to the damper lever 51 of each of the keys 31 so as to detect or measure loads on the suitable portion during the depressing stroke of the pedal PD. In such a case, it is possible to directly detect or measure loads related to the damper 36 of each of the keys 31 during the depressing stroke of the pedal PD, without imposing loads on the damper 36 by moving the key 31.

It should be appreciated that the object of the present invention can also be accomplished by supplying a system or apparatus with a storage medium having stored therein program codes of software implementing the functions of the above-described embodiment so that a computer (e.g., CPU 11, MPU or the like) of the system or apparatus reads out and executes the program codes stored in the storage medium. In such a case, the program codes read out from the storage medium themselves implement the functions of the present invention, and these program codes and the storage medium having stored there in the program codes together implement the present invention.

Furthermore, the storage medium for supplying the program codes may be, for example, a floppy (registered trademark) disk, hard disk, magneto-optical disk, CD-ROM, CD-R, CD-RW, DVD-ROM, DVD-RAM, DVD-RW, DVD+RW, magnetic tape, non-volatile memory card, ROM or the like. As an alternative, the program codes may be downloaded from a server computer via a communication network.

Moreover, whereas the functions of the above-described embodiment of the present invention have been described above as implemented by a computer reading out and executing the program codes, they may of course be implemented by an OS (operating system) and the like, running on the computer, performing a part or whole of the actual processing on the basis of the instructions of the program codes.

Furthermore, needless to say, the program codes, read out from the storage medium, may be written into a memory provided on a function extension board inserted in the computer or on a function extension unit connected to the computer so that the functions of the above-described embodiment can be implemented by a CPU and the like, provided on the function extension board or the function extension unit, performing a part or whole of the actual processing on the basis of the instructions of the program codes.

This application is based on, and claims priority to, JP PA 2013-082849 filed on 11 Apr. 2013. The disclosure of the priority application, in its entirety, including the drawings, claims, and the specification thereof, are incorporated herein by reference.

What is claimed is:

1. A method of identifying a half pedal region in a keyboard musical instrument, the keyboard musical instrument including: a plurality of keys; a plurality of dampers provided in corresponding relation to the keys; and a pedal configured to control damping action of the plurality of dampers, the half pedal region being an operating region where neither effectiveness of each of the dampers nor cancellation of the effectiveness of each of the dampers responsive to an operation of the pedal is sufficient, the method comprising:

an acquisition step of acquiring, for each of the dampers and over one stroke of the pedal in at least one of a depressing direction or a releasing direction of the pedal, loads imposed on a portion linked to the respective damper, in association with individual stroke positions of the pedal; and an identification step of identifying, for each of the dampers, the half pedal region based on relationship between the individual stroke positions and the loads, acquired in the acquisition step, corresponding to the individual stroke positions.

2. The method as claimed in claim 1, wherein the acquisition step includes, for each of the dampers:

a step of performing first measurement for measuring, as the loads imposed on the portion linked to the respective damper and with the key corresponding to the respective damper maintained at a first half position, loads imposed on a portion of the key acting on the respective damper, in association with the individual stroke positions of the pedal, wherein the first half position is a position in a key-damper half region except for a rest-position-side end position of the key-damper half region, the key-damper half region being an operating region of the respective key where neither effectiveness of the respective damper nor cancellation of the effectiveness of the respective damper responsive to an operation of the respective key is sufficient; and a step of performing second measurement for measuring, as the loads imposed on the portion linked to the respective damper and with the key corresponding to the respective damper maintained at a second half position, loads imposed on the portion of the key acting on the respective damper, in association with the individual stroke positions of the pedal, wherein the second half position is a position in the key-damper half region except for the rest-position-side end position and the first half position of the key-damper half region.

3. The method as claimed in claim 2, wherein:

the keyboard musical instrument further includes key drive units provided in corresponding relation to the plurality of keys and configured to drive the plurality of keys independently of each other, and the steps of performing the first measurement and the second measurement each measure, as the loads imposed on the portion of key acting on the respective damper, loads imposed on the key drive unit corresponding to the respective key.

4. The method as claimed in claim 2, wherein, for each of the dampers, the identification step:

identifies first two sudden change points at which a curve indicative of relationship between the stroke positions and the loads measured by the first measurement suddenly changes in inclination, identifies second two sudden change points at which a curve indicative of relationship between the stroke positions and the loads measured by the second measurement suddenly changes in inclination, and identifies the half pedal region based on the first two sudden change points and the second two sudden change points.

5. The method as claimed in claim 1, wherein the acquisition step moves the pedal at a substantially constant speed over the one stroke in the at least one of the depressing direction or the releasing direction of the pedal.

6. The method as claimed in claim 3, wherein the acquisition step simultaneously acquires the load information associated with the individual stroke positions of the pedal by moving the pedal over the one stroke in the at least one of the depressing direction or the releasing direction while collectively controlling the plurality of keys to be maintained at the first or second half position with the key drive units.

7. The method as claimed in claim 3, wherein the second half position is a depression-end-side end position of the key-damper half region.

8. The method as claimed in claim 1, further comprising the step of determining a half point for each of the dampers based on the half pedal region identified for the respective damper.

9. An apparatus for identifying a half pedal region in a keyboard musical instrument, the keyboard musical instrument including: a plurality of keys; a plurality of dampers provided in corresponding relation to the keys; and a pedal configured to control damping action of the plurality of dampers, the half pedal region being an operating region where neither effectiveness of each of the dampers nor cancellation of the effectiveness of each of the dampers responsive to an operation of the pedal is sufficient, the apparatus comprising:

a processor configured to:

acquire, for each of the dampers and over one stroke of the pedal in at least one of a depressing direction or a releasing direction of the pedal, loads imposed on a portion linked to the respective damper, in association with individual stroke positions of the pedal; and identify, for each of the dampers, the half pedal region based on relationship between the individual stroke positions and the loads corresponding to the individual stroke positions.

10. The apparatus as claimed in claim 9, wherein the processor is further configured to, for each of the dampers:

perform first measurement for measuring, as the loads imposed on the portion linked to the respective damper and with the key corresponding to the respective damper maintained at a first half position, loads imposed on a portion of the key acting on the respective damper, in association with the individual stroke positions of the pedal, wherein the first half position is a position in a key-damper half region except for a rest-position-side end position of the key-damper half region, the key-damper half region being an operating region of the respective key where neither effectiveness of the respective damper nor cancellation of the effectiveness of the respective damper responsive to an operation of the respective key is sufficient; and perform second measurement for measuring, as the loads imposed on the portion linked to the respective damper and with the key corresponding to the respective damper maintained at a second half position, loads imposed on the portion of the key acting on the respective damper, in association with the individual stroke positions of the pedal, wherein the second half position is a position in the key-damper half region except for the rest-position-side end position and the first half position of the key-damper half region.

11. The apparatus as claimed in claim 10, wherein:

the keyboard musical instrument further includes key drive units provided in corresponding relation to the plurality of keys and configured to drive the plurality of keys independently of each other, and the processor measures, as the loads imposed on the portion of the respective key acting on the respective damper, loads imposed on the key drive unit corresponding to the respective key.

12. An apparatus for identifying a half pedal region in a keyboard musical instrument, the keyboard musical instrument including: a plurality of keys; a plurality of dampers provided in corresponding relation to the keys; and a pedal configured to control damping action of the plurality of dampers, the half pedal region being an operating region where neither effectiveness of each of the dampers nor cancellation of the effectiveness of each of the dampers responsive to an operation of the pedal is sufficient, the apparatus comprising:

a sensor configured to detect a stroke position of the pedal:

a measurement unit configured to measure, for each of the dampers, a load imposed on a portion linked to the respective damper;

a first control device configured to acquire, for each of the dampers and over one stroke of the pedal in at least one of a depressing direction or a releasing direction of the pedal, loads imposed on the portion linked to the respective damper, in association with individual stroke positions of the pedal; and a second control device configured to identify, for each of the dampers, the half pedal region based on relationship between the individual stroke positions and the loads corresponding to the individual stroke positions.

13. The apparatus as claimed in claim 12, wherein the first control device is configured to, for each of the dampers:

perform first measurement for measuring, as the loads imposed on the portion linked to the respective damper and with the key corresponding to the respective damper maintained at a first half position, loads imposed on a portion of the key acting on the respective damper, in association with the individual stroke positions of the pedal, wherein the first half position is a position in a key-damper half region except for a rest-position-side end position of the key-damper half region, the key-damper half region being an operating region of the respective key where neither effectiveness of the respective damper nor cancellation of the effectiveness of the respective damper responsive to an operation of the respective key is sufficient; and perform second measurement for measuring, as the loads imposed on the portion linked to the respective damper and with the key corresponding to the respective damper maintained at a second half position, loads imposed on the portion of the key acting on the respective damper, in association with the individual stroke positions of the pedal, wherein the second half position is a position in the key-damper half region except for the rest-position-side end position and the first half position of the key-damper half region.

14. The apparatus as claimed in claim 13, wherein:

the keyboard musical instrument further includes key drive units provided in corresponding relation to the plurality of keys and configured to drive the plurality of keys independently of each other, and the first control device measures, as the loads imposed on the portion of the respective key acting on the respective damper, loads imposed on the key drive unit corresponding to the respective key.

15. A non-transitory computer-readable storage medium storing a program executable by a processor for implementing a method of identifying a half pedal region in a keyboard musical instrument, the keyboard musical instrument including: a plurality of keys; a plurality of dampers provided in corresponding relation to the keys; and a pedal configured to control damping action of the plurality of dampers, the half pedal region being an operating region where neither effectiveness of each of the dampers nor cancellation of the effectiveness of each of the dampers responsive to an operation of the pedal is sufficient, the method comprising:

an acquisition step of acquiring, for each of the dampers and over one stroke of the pedal in at least one of a depressing direction or a releasing direction of the pedal, loads imposed on a portion linked to the respective damper, in association with individual stroke positions of the pedal; and an identification step of identifying, for each of the dampers, the half pedal region based on relationship between the individual stroke positions and the loads, acquired in the acquisition step, corresponding to the individual stroke positions.

* * * * *